US009336789B2

(12) United States Patent
Rajendran et al.

(10) Patent No.: US 9,336,789 B2
(45) Date of Patent: May 10, 2016

(54) SYSTEMS AND METHODS FOR DETERMINING AN INTERPOLATION FACTOR SET FOR SYNTHESIZING A SPEECH SIGNAL

(71) Applicant: QUALCOMM Incorporated, San Diego, CA (US)

(72) Inventors: Vivek Rajendran, San Diego, CA (US); Subasingha Shaminda Subasingha, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 193 days.

(21) Appl. No.: 14/015,834

(22) Filed: Aug. 30, 2013

(65) Prior Publication Data

US 2014/0236583 A1 Aug. 21, 2014

Related U.S. Application Data

(60) Provisional application No. 61/767,461, filed on Feb. 21, 2013.

(51) Int. Cl.
*G10L 19/07* (2013.01)
*G10L 19/005* (2013.01)

(52) U.S. Cl.
CPC ..... *G10L 19/07* (2013.01); *G10L 19/005* (2013.01)

(58) Field of Classification Search
CPC ..... G10L 19/07
USPC ..... 704/207, 205
See application file for complete search history.

(56) References Cited

U.S. PATENT DOCUMENTS

| | | | | |
|---|---|---|---|---|
| 4,975,956 | A | 12/1990 | Liu et al. | |
| 5,012,518 | A | 4/1991 | Liu et al. | |
| 5,826,221 | A | 10/1998 | Aoyagi | |
| 5,832,436 | A * | 11/1998 | Hsieh | 704/265 |
| 5,963,898 | A * | 10/1999 | Navarro et al. | 704/220 |
| 6,157,907 | A | 12/2000 | Taori et al. | |
| 6,574,593 | B1 | 6/2003 | Gao et al. | |
| 8,078,457 | B2 * | 12/2011 | Ghenania et al. | 704/219 |
| 8,260,609 | B2 * | 9/2012 | Rajendran et al. | 704/210 |
| 8,428,938 | B2 * | 4/2013 | Fang et al. | 704/226 |

(Continued)

FOREIGN PATENT DOCUMENTS

| | | |
|---|---|---|
| GB | 2466670 A | 7/2010 |
| TW | 269081 | 1/1996 |

(Continued)

OTHER PUBLICATIONS

Taiwan Search Report—TW103101043—TIPO—Feb. 6, 2015.

(Continued)

*Primary Examiner* — Susan McFadden
(74) *Attorney, Agent, or Firm* — Austin Rapp & Hardman

(57) ABSTRACT

A method for determining an interpolation factor set by an electronic device is described. The method includes determining a value based on a current frame property and a previous frame property. The method also includes determining whether the value is outside of a range. The method further includes determining an interpolation factor set based on the value and a prediction mode indicator if the value is outside of the range. The method additionally includes synthesizing a speech signal.

32 Claims, 16 Drawing Sheets

(56) References Cited

U.S. PATENT DOCUMENTS

| | | | | |
|---|---|---|---|---|
| 8,468,015 | B2 * | 6/2013 | Ehara | 704/219 |
| 8,532,984 | B2 * | 9/2013 | Rajendran et al. | 704/205 |
| 8,538,765 | B1 * | 9/2013 | Ehara | 704/500 |
| 8,670,981 | B2 * | 3/2014 | Vos et al. | 704/205 |
| 8,712,765 | B2 * | 4/2014 | Ehara | 704/219 |
| 2007/0061135 | A1 | 3/2007 | Chu et al. | |
| 2009/0319263 | A1 | 12/2009 | Gupta et al. | |
| 2010/0174532 | A1 | 7/2010 | Vos et al. | |

FOREIGN PATENT DOCUMENTS

| | | | |
|---|---|---|---|
| TW | 493161 | | 7/2002 |
| WO | WO-9516315 | A1 | 6/1995 |
| WO | 9852187 | A1 | 11/1998 |
| WO | 2011148230 | A1 | 12/2011 |

OTHER PUBLICATIONS

International Search Report and Written Opinion—PCT/US2013/057867—ISA/EPO—Dec. 20, 2013.

* cited by examiner

SYSTEMS AND METHODS FOR DETERMINING AN INTERPOLATION FACTOR SET FOR SYNTHESIZING A SPEECH SIGNAL

RELATED APPLICATIONS

This application is related to and claims priority to U.S. Provisional Patent Application Ser. No. 61/767,461 filed Feb. 21, 2013, for "SYSTEMS AND METHODS FOR DETERMINING A SET OF INTERPOLATION FACTORS."

TECHNICAL FIELD

The present disclosure relates generally to electronic devices. More specifically, the present disclosure relates to systems and methods for determining an interpolation factor set.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform new functions and/or that perform functions faster, more efficiently or with higher quality are often sought after.

Some electronic devices (e.g., cellular phones, smartphones, audio recorders, camcorders, computers, etc.) utilize audio signals. These electronic devices may encode, store and/or transmit the audio signals. For example, a smartphone may obtain, encode and transmit a speech signal for a phone call, while another smartphone may receive and decode the speech signal.

However, particular challenges arise in encoding, transmitting and decoding of audio signals. For example, an audio signal may be encoded in order to reduce the amount of bandwidth required to transmit the audio signal. When a portion of the audio signal is lost in transmission, it may be difficult to present an accurately decoded audio signal. As can be observed from this discussion, systems and methods that improve decoding may be beneficial.

SUMMARY

A method for determining an interpolation factor set by an electronic device is described. The method includes determining a value based on a current frame property and a previous frame property. The method also includes determining whether the value is outside of a range. The method further includes determining an interpolation factor set based on the value and a prediction mode indicator if the value is outside of the range. The method additionally includes synthesizing a speech signal.

Determining the interpolation factor set may be based on a degree to which the value is outside of the range. The degree to which the value is outside of the range may be determined based on one or more thresholds outside of the range.

The prediction mode indicator may indicate one of two prediction modes. The prediction mode indicator may indicate one of three or more prediction modes.

The value may be an energy ratio based on a current frame synthesis filter impulse response energy and a previous frame synthesis filter impulse response energy. Determining whether the value is outside of the range may include determining whether the energy ratio is less than a threshold. The value may include a current frame first reflection coefficient and a previous frame first reflection coefficient. Determining whether the value is outside of the range may include determining whether the previous frame first reflection coefficient is greater than a first threshold and the current frame first reflection coefficient is less than a second threshold.

The method may include interpolating subframe line spectral frequency (LSF) vectors based on the interpolation factor set. Interpolating subframe LSF vectors based on the interpolation factor set may include multiplying a current frame end LSF vector by a first interpolation factor, multiplying a previous frame end LSF vector by a second interpolation factor and multiplying a current frame mid LSF vector by a difference factor.

The interpolation factor set may include two or more interpolation factors. The method may include utilizing a default interpolation factor set if the value is not outside of the range.

The prediction mode indicator may indicate a prediction mode of a current frame. The prediction mode indicator may indicate a prediction mode of a previous frame.

An electronic device for determining an interpolation factor set is also described. The electronic device includes value determination circuitry that determines a value based on a current frame property and a previous frame property. The electronic device also includes interpolation factor set determination circuitry coupled to the value determination circuitry. The interpolation factor set determination circuitry determines whether the value is outside of a range and determines an interpolation factor set based on the value and a prediction mode indicator if the value is outside of the range. The electronic device also includes synthesis filter circuitry that synthesizes a speech signal.

A computer-program product for determining an interpolation factor set is also described. The computer-program product includes a non-transitory tangible computer-readable medium with instructions. The instructions include code for causing an electronic device to determine a value based on a current frame property and a previous frame property. The instructions also include code for causing the electronic device to determine whether the value is outside of a range. The instructions further include code for causing the electronic device to determine an interpolation factor set based on the value and a prediction mode indicator if the value is outside of the range. The instructions additionally include code for causing the electronic device to synthesize a speech signal.

An apparatus for determining an interpolation factor set is also described. The apparatus includes means for determining a value based on a current frame property and a previous frame property. The apparatus also includes means for determining whether the value is outside of a range. The apparatus further includes means for determining an interpolation factor set based on the value and a prediction mode indicator if the value is outside of the range. The apparatus additionally includes means for synthesizing a speech signal.

DETAILED DESCRIPTION

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

Figure 1:
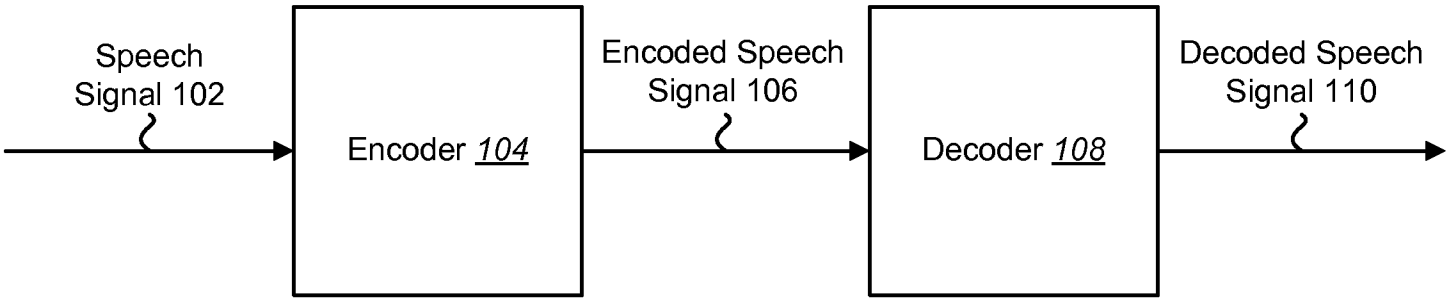
FIG. 1 is a block diagram illustrating a general example of an encoder and a decoder.

FIG. 1 is a block diagram illustrating a general example of an encoder 104 and a decoder 108. The encoder 104 receives a speech signal 102. The speech signal 102 may be a speech signal in any frequency range. For example, the speech signal 102 may be sampled at 16 kilobits per second (kbps) and may be a superwideband signal with an approximate frequency range of 0-16 kilohertz (kHz) or 0-14 kHz, a wideband signal with an approximate frequency range of 0-8 kHz or a narrowband signal with an approximate frequency range of 0-4 kHz. In other examples, the speech signal 102 may be a lowband signal with an approximate frequency range of 50-300 hertz (Hz) or a highband signal with an approximate frequency range of 4-8 kHz. Other possible frequency ranges for the speech signal 102 include 300-3400 Hz (e.g., the frequency range of the Public Switched Telephone Network (PSTN)), 14-20 kHz, 16-20 kHz and 16-32 kHz.

The encoder 104 encodes the speech signal 102 to produce an encoded speech signal 106. In general, the encoded speech signal 106 includes one or more parameters that represent the speech signal 102. One or more of the parameters may be quantized. Examples of the one or more parameters include filter parameters (e.g., weighting factors, line spectral frequencies (LSFs), prediction mode indicators, line spectral pairs (LSPs), immittance spectral frequencies (ISFs), immittance spectral pairs (ISPs), partial correlation (PARCOR) coefficients, reflection coefficients and/or log-area-ratio values, etc.) and parameters included in an encoded excitation signal (e.g., gain factors, adaptive codebook indices, adaptive codebook gains, fixed codebook indices and/or fixed codebook gains, etc.). The parameters may correspond to one or more frequency bands. The decoder 108 decodes the encoded speech signal 106 to produce a decoded speech signal 110. For example, the decoder 108 constructs the decoded speech signal 110 based on the one or more parameters included in the encoded speech signal 106. The decoded speech signal 110 may be an approximate reproduction of the original speech signal 102.

The encoder 104 may be implemented in hardware (e.g., circuitry), software or a combination of both. For example, the encoder 104 may be implemented as an application-specific integrated circuit (ASIC) or as a processor with instructions. Similarly, the decoder 108 may be implemented in hardware (e.g., circuitry), software or a combination of both. For example, the decoder 108 may be implemented as an application-specific integrated circuit (ASIC) or as a processor with instructions. The encoder 104 and the decoder 108 may be implemented on separate electronic devices or on the same electronic device.

Figure 2:
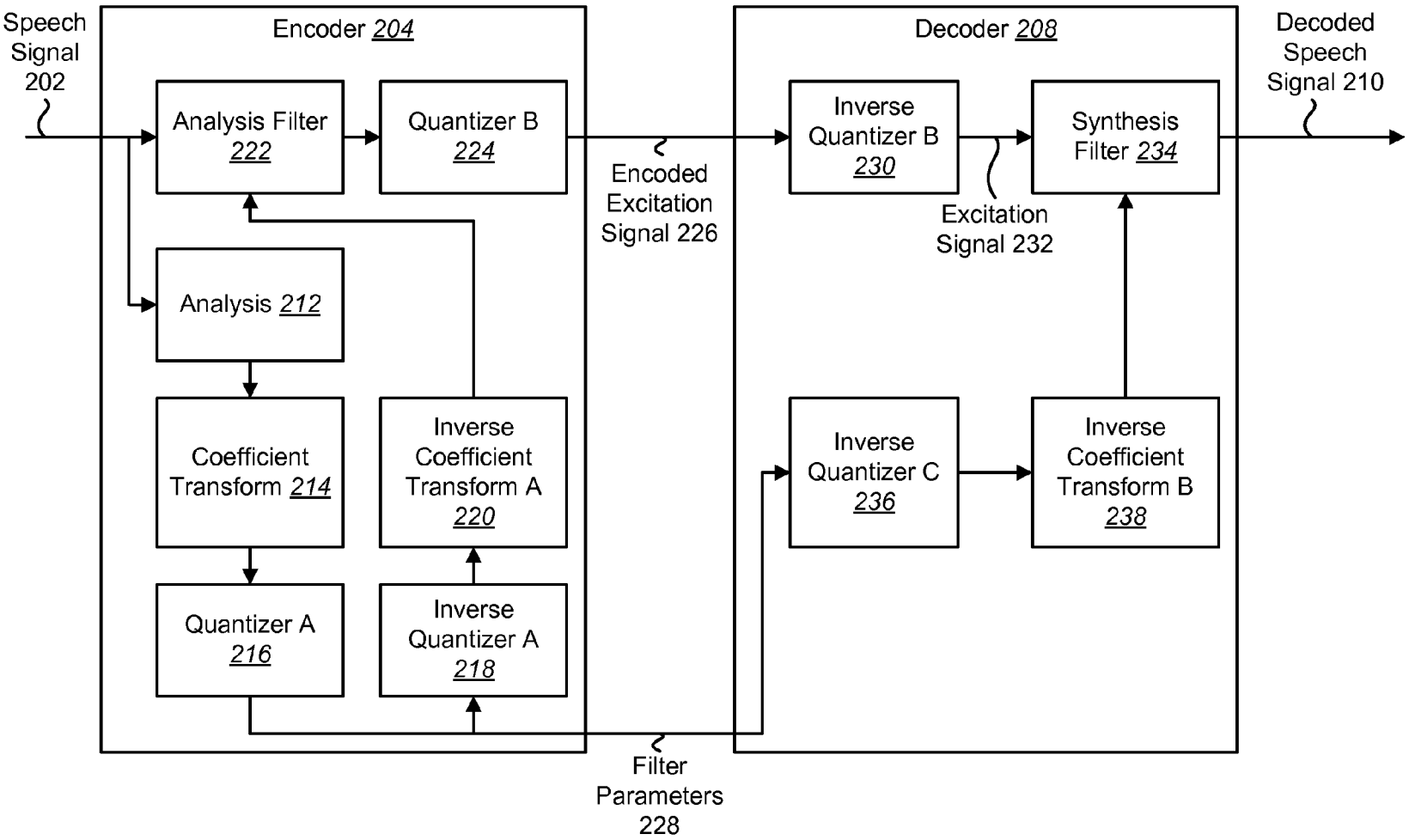
FIG. 2 is a block diagram illustrating an example of a basic implementation of an encoder and a decoder.

FIG. 2 is a block diagram illustrating an example of a basic implementation of an encoder 204 and a decoder 208. The encoder 204 may be one example of the encoder 104 described in connection with FIG. 1. The encoder 204 may include an analysis module 212, a coefficient transform 214, quantizer A 216, inverse quantizer A 218, inverse coefficient transform A 220, an analysis filter 222 and quantizer B 224. One or more of the components of the encoder 204 and/or decoder 208 may be implemented in hardware (e.g., circuitry), software or a combination of both.

The encoder 204 receives a speech signal 202. It should be noted that the speech signal 202 may include any frequency range as described above in connection with FIG. 1 (e.g., an entire band of speech frequencies or a subband of speech frequencies).

In this example, the analysis module 212 encodes the spectral envelope of a speech signal 202 as a set of linear prediction (LP) coefficients (e.g., analysis filter coefficients A(z), which may be applied to produce an all-pole synthesis filter 1/A(z), where z is a complex number). The analysis module 212 typically processes the input signal as a series of non-overlapping frames of the speech signal 202, with a new set of coefficients being calculated for each frame or subframe. In some configurations, the frame period may be a period over which the speech signal 202 may be expected to be locally stationary. One common example of the frame period is 20 milliseconds (ms) (equivalent to 160 samples at a sampling rate of 8 kHz, for example). In one example, the analysis module 212 is configured to calculate a set of ten linear prediction coefficients to characterize the formant structure of each 20-ms frame. In another example, a sampling rate of 12.8 kHz may be utilized for a 20-ms frame. In this example, the frame size is 256 samples and the analysis module 212 may calculate a set of 16 linear prediction coefficients (e.g., 16th order linear prediction coefficients). While these are examples of frameworks that may be implemented in accordance with the systems and methods disclosed herein, it should be noted that these examples should not limit the scope of the systems and methods disclosed, which may be applied to any framework. It is also possible to implement the analysis module 212 to process the speech signal 202 as a series of overlapping frames.

The analysis module 212 may be configured to analyze the samples of each frame directly, or the samples may be weighted first according to a windowing function (e.g., a Hamming window). The analysis may also be performed over a window that is larger than the frame, such as a 30-ms window. This window may be symmetric (e.g., 5-20-5, such that it includes the 5 ms immediately before and after the 20-millisecond frame) or asymmetric (e.g., 10-20, such that it includes the last 10 ms of the preceding frame). The analysis module 212 is typically configured to calculate the linear prediction coefficients using a Levinson-Durbin recursion or the Leroux-Gueguen algorithm. In another implementation, the analysis module 212 may be configured to calculate a set of cepstral coefficients for each frame instead of a set of linear prediction coefficients.

The output rate of the encoder 204 may be reduced significantly, with relatively little effect on reproduction quality, by quantizing the coefficients. Linear prediction coefficients are difficult to quantize efficiently and are usually mapped into another representation, such as LSFs for quantization and/or entropy encoding. In the example of FIG. 2, the coefficient transform 214 transforms the set of coefficients into a corresponding LSF vector (e.g., set of LSFs). Other one-to-one representations of coefficients include LSPs, PARCOR coefficients, reflection coefficients, log-area-ratio values, ISPs and ISFs. For example, ISFs may be used in the GSM (Global System for Mobile Communications) AMR-WB (Adaptive Multirate-Wideband) codec. For convenience, the term "line spectral frequencies," "LSFs," "LSF vectors" and related terms may be used to refer to one or more of LSFs, LSPs, ISFs, ISPs, PARCOR coefficients, reflection coefficients and log-area-ratio values. Typically, a transform between a set of coefficients and a corresponding LSF vector is reversible, but some configurations may include implementations of the encoder 204 in which the transform is not reversible without error.

Quantizer A 216 is configured to quantize the LSF vector (or other coefficient representation). The encoder 204 may output the result of this quantization as filter parameters 228. Quantizer A 216 typically includes a vector quantizer that encodes the input vector (e.g., the LSF vector) as an index to a corresponding vector entry in a table or codebook.

As seen in FIG. 2, the encoder 204 also generates a residual signal by passing the speech signal 202 through an analysis filter 222 (also called a whitening or prediction error filter) that is configured according to the set of coefficients. The analysis filter 222 may be implemented as a finite impulse response (FIR) filter or an infinite impulse response (IIR) filter. This residual signal will typically contain perceptually important information of the speech frame, such as long-term structure relating to pitch, that is not represented in the filter parameters 228. Quantizer B 224 is configured to calculate a quantized representation of this residual signal for output as an encoded excitation signal 226. In some configurations, quantizer B 224 includes a vector quantizer that encodes the input vector as an index to a corresponding vector entry in a table or codebook. Additionally or alternatively, quantizer B 224 may be configured to send one or more parameters from which the vector may be generated dynamically at the decoder 208, rather than retrieved from storage, as in a sparse codebook method. Such a method is used in coding schemes such as algebraic CELP (code-excited linear prediction) and codecs such as 3GPP2 (Third Generation Partnership 2) EVRC (Enhanced Variable Rate Codec). In some configurations, the encoded excitation signal 226 and the filter parameters 228 may be included in an encoded speech signal 106.

It may be beneficial for the encoder 204 to generate the encoded excitation signal 226 according to the same filter parameter values that will be available to the corresponding decoder 208. In this manner, the resulting encoded excitation signal 226 may already account to some extent for non-idealities in those parameter values, such as quantization error. Accordingly, it may be beneficial to configure the analysis filter 222 using the same coefficient values that will be available at the decoder 208. In the basic example of the encoder 204 as illustrated in FIG. 2, inverse quantizer A 218 dequantizes the filter parameters 228. Inverse coefficient transform A 220 maps the resulting values back to a corresponding set of coefficients. This set of coefficients is used to configure the analysis filter 222 to generate the residual signal that is quantized by quantizer B 224.

Some implementations of the encoder 204 are configured to calculate the encoded excitation signal 226 by identifying one among a set of codebook vectors that best matches the residual signal. It is noted, however, that the encoder 204 may also be implemented to calculate a quantized representation of the residual signal without actually generating the residual signal. For example, the encoder 204 may be configured to use a number of codebook vectors to generate corresponding synthesized signals (according to a current set of filter parameters, for example) and to select the codebook vector associated with the generated signal that best matches the original speech signal 202 in a perceptually weighted domain.

The decoder 208 may include inverse quantizer B 230, inverse quantizer C 236, inverse coefficient transform B 238 and a synthesis filter 234. Inverse quantizer C 236 dequantizes the filter parameters 228 (an LSF vector, for example) and inverse coefficient transform B 238 transforms the LSF vector into a set of coefficients (for example, as described above with reference to inverse quantizer A 218 and inverse coefficient transform A 220 of the encoder 204). Inverse quantizer B 230 dequantizes the encoded excitation signal 226 to produce an excitation signal 232. Based on the coefficients and the excitation signal 232, the synthesis filter 234 synthesizes a decoded speech signal 210. In other words, the synthesis filter 234 is configured to spectrally shape the excitation signal 232 according to the dequantized coefficients to produce the decoded speech signal 210. In some configurations, the decoder 208 may also provide the excitation signal 232 to another decoder, which may use the excitation signal 232 to derive an excitation signal of another frequency band (e.g., a highband). In some implementations, the decoder 208 may be configured to provide additional information to another decoder that relates to the excitation signal 232, such as spectral tilt, pitch gain and lag and speech mode.

The system of the encoder 204 and the decoder 208 is a basic example of an analysis-by-synthesis speech codec. Codebook excitation linear prediction coding is one popular family of analysis-by-synthesis coding. Implementations of such coders may perform waveform encoding of the residual, including such operations as selection of entries from fixed and adaptive codebooks, error minimization operations and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse excitation (MPE), multi-pulse CELP (MP-CELP), and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10) (which uses residual excited linear prediction (RELP)), the GSM enhanced full rate codec (ETSI-GSM 06.60), the ITU (International Telecommunication Union) standard 11.8 kbps G.729 Annex E coder, the IS (Interim Standard)-641 codecs for IS-136 (a time-division multiple access scheme), the GSM adaptive multirate (GSM-AMR) codecs and the 4GV™ (Fourth-Generation Vocoder™) codec (QUALCOMM Incorporated, San Diego, Calif.). The encoder 204 and corresponding decoder 208 may be implemented according to any of these technologies, or any other speech coding technology (whether known or to be developed) that represents a speech signal as (A) a set of parameters that describe a filter and (B) an excitation signal used to drive the described filter to reproduce the speech signal.

Even after the analysis filter 222 has removed the coarse spectral envelope from the speech signal 202, a considerable amount of fine harmonic structure may remain, especially for voiced speech. Periodic structure is related to pitch, and different voiced sounds spoken by the same speaker may have different formant structures but similar pitch structures.

Coding efficiency and/or speech quality may be increased by using one or more parameter values to encode characteristics of the pitch structure. One important characteristic of the pitch structure is the frequency of the first harmonic (also called the fundamental frequency), which is typically in the range of 60 to 400 hertz (Hz). This characteristic is typically encoded as the inverse of the fundamental frequency, also called the pitch lag. The pitch lag indicates the number of samples in one pitch period and may be encoded as one or more codebook indices. Speech signals from male speakers tend to have larger pitch lags than speech signals from female speakers.

Another signal characteristic relating to the pitch structure is periodicity, which indicates the strength of the harmonic structure or, in other words, the degree to which the signal is harmonic or non-harmonic. Two typical indicators of periodicity are zero crossings and normalized autocorrelation functions (NACFs). Periodicity may also be indicated by the pitch gain, which is commonly encoded as a codebook gain (e.g., a quantized adaptive codebook gain).

The encoder 204 may include one or more modules configured to encode the long-term harmonic structure of the speech signal 202. In some approaches to CELP encoding, the encoder 204 includes an open-loop linear predictive coding (LPC) analysis module, which encodes the short-term characteristics or coarse spectral envelope, followed by a closed-loop long-term prediction analysis stage, which encodes the fine pitch or harmonic structure. The short-term characteristics are encoded as coefficients (e.g., filter parameters 228), and the long-term characteristics are encoded as values for parameters such as pitch lag and pitch gain. For example, the encoder 204 may be configured to output the encoded excitation signal 226 in a form that includes one or more codebook indices (e.g., a fixed codebook index and an adaptive codebook index) and corresponding gain values. Calculation of this quantized representation of the residual signal (e.g., by quantizer B 224) may include selecting such indices and calculating such values. Encoding of the pitch structure may also include interpolation of a pitch prototype waveform, which operation may include calculating a difference between successive pitch pulses. Modeling of the long-term structure may be disabled for frames corresponding to unvoiced speech, which is typically noise-like and unstructured.

Some implementations of the decoder 208 may be configured to output the excitation signal 232 to another decoder (e.g., a highband decoder) after the long-term structure (pitch or harmonic structure) has been restored. For example, such a decoder may be configured to output the excitation signal 232 as a dequantized version of the encoded excitation signal 226. Of course, it is also possible to implement the decoder 208 such that the other decoder performs dequantization of the encoded excitation signal 226 to obtain the excitation signal 232.

Figure 3:
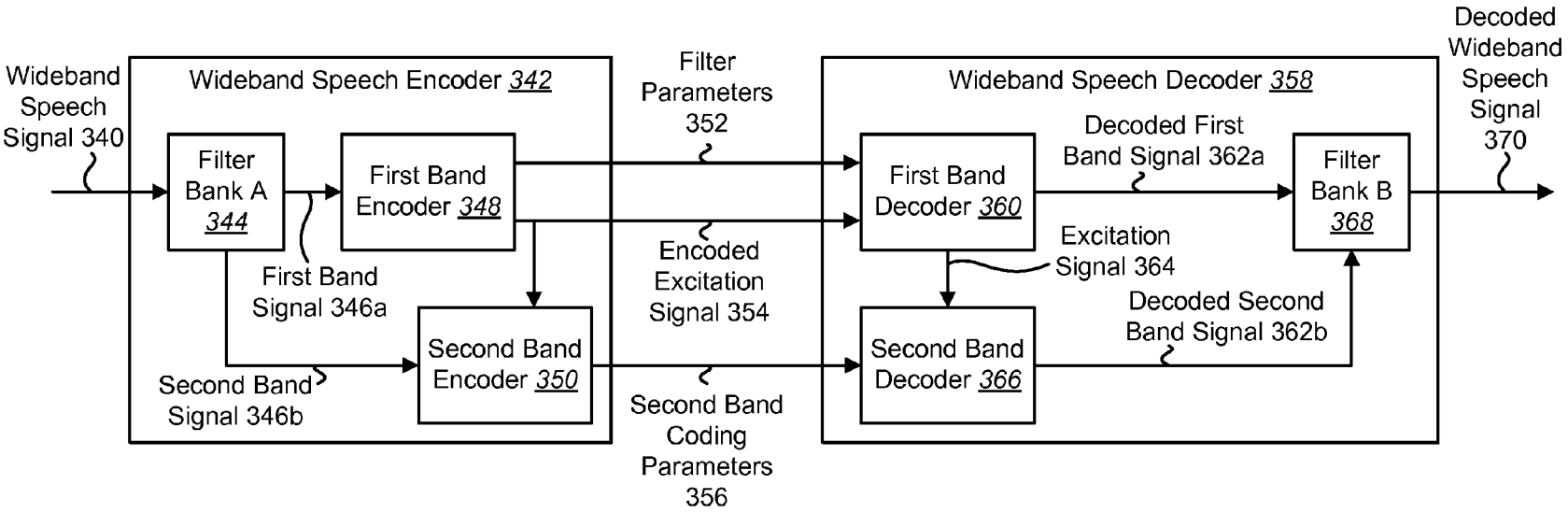
FIG. 3 is a block diagram illustrating an example of a wideband speech encoder and a wideband speech decoder.

FIG. 3 is a block diagram illustrating an example of a wideband speech encoder 342 and a wideband speech decoder 358. One or more components of the wideband speech encoder 342 and/or the wideband speech decoder 358 may be implemented in hardware (e.g., circuitry), software or a combination of both. The wideband speech encoder 342 and the wideband speech decoder 358 may be implemented on separate electronic devices or on the same electronic device.

The wideband speech encoder 342 includes filter bank A 344, a first band encoder 348 and a second band encoder 350. Filter bank A 344 is configured to filter a wideband speech signal 340 to produce a first band signal 346*a* (e.g., a narrowband signal) and a second band signal 346*b* (e.g., a highband signal).

The first band encoder 348 is configured to encode the first band signal 346*a* to produce filter parameters 352 (e.g., narrowband (NB) filter parameters) and an encoded excitation signal 354 (e.g., an encoded narrowband excitation signal). In some configurations, the first band encoder 348 may produce the filter parameters 352 and the encoded excitation signal 354 as codebook indices or in another quantized form. In some configurations, the first band encoder 348 may be implemented in accordance with the encoder 204 described in connection with FIG. 2.

The second band encoder 350 is configured to encode the second band signal 346*b* (e.g., a highband signal) according to information in the encoded excitation signal 354 to produce second band coding parameters 356 (e.g., highband coding parameters). The second band encoder 350 may be configured to produce second band coding parameters 356 as codebook indices or in another quantized form. One particular example of a wideband speech encoder 342 is configured to encode the wideband speech signal 340 at a rate of about 8.55 kbps, with about 7.55 kbps being used for the filter parameters 352 and encoded excitation signal 354, and about 1 kbps being used for the second band coding parameters 356. In some implementations, the filter parameters 352, the encoded excitation signal 354 and the second band coding parameters 356 may be included in an encoded speech signal 106.

In some configurations, the second band encoder 350 may be implemented similar to the encoder 204 described in connection with FIG. 2. For example, the second band encoder 350 may produce second band filter parameters (as part of the second band coding parameters 356, for instance) as described in connection with the encoder 204 described in connection with FIG. 2. However, the second band encoder 350 may differ in some respects. For example, the second band encoder 350 may include a second band excitation generator, which may generate a second band excitation signal based on the encoded excitation signal 354. The second band encoder 350 may utilize the second band excitation signal to produce a synthesized second band signal and to determine a second band gain factor. In some configurations, the second band encoder 350 may quantize the second band gain factor. Accordingly, examples of the second band coding parameters include second band filter parameters and a quantized second band gain factor.

It may be beneficial to combine the filter parameters 352, the encoded excitation signal 354 and the second band coding parameters 356 into a single bitstream. For example, it may be beneficial to multiplex the encoded signals together for transmission (e.g., over a wired, optical, or wireless transmission channel) or for storage, as an encoded wideband speech signal. In some configurations, the wideband speech encoder 342 includes a multiplexer (not shown) configured to combine the filter parameters 352, encoded excitation signal 354 and second band coding parameters 356 into a multiplexed signal. The filter parameters 352, the encoded excitation signal 354 and the second band coding parameters 356 may be examples of parameters included in an encoded speech signal 106 as described in connection with FIG. 1.

In some implementations, an electronic device that includes the wideband speech encoder 342 may also include circuitry configured to transmit the multiplexed signal into a transmission channel such as a wired, optical, or wireless channel. Such an electronic device may also be configured to perform one or more channel encoding operations on the signal, such as error correction encoding (e.g., rate-compatible convolutional encoding) and/or error detection encoding (e.g., cyclic redundancy encoding), and/or one or more layers of network protocol encoding (e.g., Ethernet, Transmission Control Protocol/Internet Protocol (TCP/IP), cdma2000, etc.).

It may be beneficial for the multiplexer to be configured to embed the filter parameters 352 and the encoded excitation signal 354 as a separable substream of the multiplexed signal, such that the filter parameters 352 and encoded excitation signal 354 may be recovered and decoded independently of another portion of the multiplexed signal such as a highband and/or lowband signal. For example, the multiplexed signal may be arranged such that the filter parameters 352 and encoded excitation signal 354 may be recovered by stripping away the second band coding parameters 356. One potential advantage of such a feature is to avoid the need for transcoding the second band coding parameters 356 before passing it to a system that supports decoding of the filter parameters 352 and encoded excitation signal 354 but does not support decoding of the second band coding parameters 356.

The wideband speech decoder 358 may include a first band decoder 360, a second band decoder 366 and filter bank B 368. The first band decoder 360 (e.g., a narrowband decoder) is configured to decode the filter parameters 352 and encoded excitation signal 354 to produce a decoded first band signal 362*a* (e.g., a decoded narrowband signal). The second band decoder 366 is configured to decode the second band coding parameters 356 according to an excitation signal 364 (e.g., a narrowband excitation signal), based on the encoded excitation signal 354, to produce a decoded second band signal 362*b* (e.g., a decoded highband signal). In this example, the first band decoder 360 is configured to provide the excitation signal 364 to the second band decoder 366. Filter bank B 368 is configured to combine the decoded first band signal 362*a* and the decoded second band signal 362*b* to produce a decoded wideband speech signal 370.

Some implementations of the wideband speech decoder 358 may include a demultiplexer (not shown) configured to produce the filter parameters 352, the encoded excitation signal 354 and the second band coding parameters 356 from a multiplexed signal. An electronic device including the wideband speech decoder 358 may include circuitry configured to receive the multiplexed signal from a transmission channel such as a wired, optical or wireless channel. Such an electronic device may also be configured to perform one or more channel decoding operations on the signal, such as error correction decoding (e.g., rate-compatible convolutional decoding) and/or error detection decoding (e.g., cyclic redundancy decoding), and/or one or more layers of network protocol decoding (e.g., Ethernet, TCP/IP, cdma2000).

Filter bank A 344 in the wideband speech encoder 342 is configured to filter an input signal according to a split-band scheme to produce a first band signal 346*a* (e.g., a narrowband or low-frequency subband signal) and a second band signal 346*b* (e.g., a highband or high-frequency subband signal). Depending on the design criteria for the particular application, the output subbands may have equal or unequal bandwidths and may be overlapping or nonoverlapping. A configuration of filter bank A 344 that produces more than two subbands is also possible. For example, filter bank A 344 may be configured to produce one or more lowband signals that include components in a frequency range below that of the first band signal 346*a* (such as the range of 50-300 hertz (Hz), for example). It is also possible for filter bank A 344 to be configured to produce one or more additional highband signals that include components in a frequency range above that of the second band signal 346*b* (such as a range of 14-20, 16-20 or 16-32 kilohertz (kHz), for example). In such a configuration, the wideband speech encoder 342 may be implemented to encode the signal or signals separately and a multiplexer may be configured to include the additional encoded signal or signals in a multiplexed signal (as one or more separable portions, for example).

Figure 4:
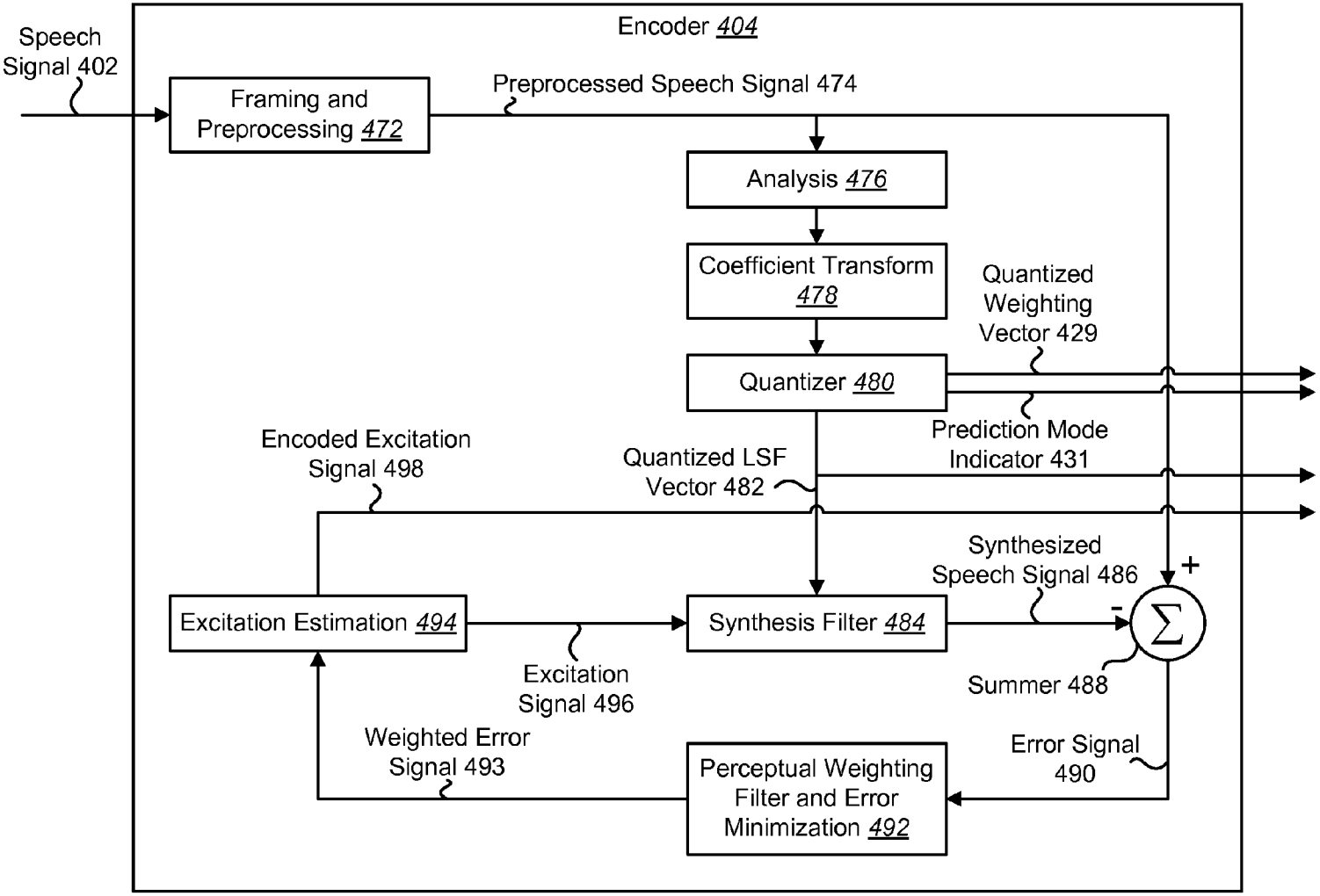
FIG. 4 is a block diagram illustrating a more specific example of an encoder.

FIG. 4 is a block diagram illustrating a more specific example of an encoder 404. In particular, FIG. 4 illustrates a CELP analysis-by-synthesis architecture for low bit rate speech encoding. In this example, the encoder 404 includes a framing and preprocessing module 472, an analysis module 476, a coefficient transform 478, a quantizer 480, a synthesis filter 484, a summer 488, a perceptual weighting filter and error minimization module 492 and an excitation estimation module 494. It should be noted that the encoder 404 and one or more of the components of the encoder 404 may be implemented in hardware (e.g., circuitry), software or a combination of both.

The speech signal 402 (e.g., input speech s) may be an electronic signal that contains speech information. For example, an acoustic speech signal may be captured by a microphone and sampled to produce the speech signal 402. In some configurations, the speech signal 402 may be sampled at 16 kbps. The speech signal 402 may comprise a range of frequencies as described above in connection with FIG. 1.

The speech signal 402 may be provided to the framing and preprocessing module 472. The framing and preprocessing module 472 may divide the speech signal 402 into a series of frames. Each frame may be a particular time period. For example, each frame may correspond to 20 ms of the speech signal 402. The framing and preprocessing module 472 may perform other operations on the speech signal 402, such as filtering (e.g., one or more of low-pass, high-pass and band-pass filtering). Accordingly, the framing and preprocessing module 472 may produce a preprocessed speech signal 474 (e.g., S(a), where a is a sample number) based on the speech signal 402.

The analysis module 476 may determine a set of coefficients (e.g., linear prediction analysis filter A(z)). For example, the analysis module 476 may encode the spectral envelope of the preprocessed speech signal 474 as a set of coefficients as described in connection with FIG. 2.

The coefficients may be provided to the coefficient transform 478. The coefficient transform 478 transforms the set of coefficients into a corresponding LSF vector (e.g., LSFs, LSPs, ISFs, ISPs, etc.) as described above in connection with FIG. 2.

The LSF vector is provided to the quantizer 480. The quantizer 480 quantizes the LSF vector into a quantized LSF vector 482. For example, the quantizer 480 may perform vector quantization on the LSF vector to yield the quantized LSF vector 482. This quantization can either be non-predictive (e.g., no previous frame LSF vector is used in the quantization process) or predictive (e.g., a previous frame LSF vector is used in the quantization process).

In some configurations, one of two prediction modes may be utilized: predictive quantization mode or non-predictive quantization mode. In non-predictive quantization mode, LSF vector quantization for a frame is independent of any prior frame LSF vector. In predictive quantization mode, LSF vector quantization for a frame is dependent on a prior frame LSF vector.

In other configurations, three or more prediction modes may be utilized. In these configurations, each of the three or more prediction modes indicates a degree of dependency to which LSF vector quantization for a frame depends on a prior frame LSF vector. In one example, three prediction modes may be utilized. For instance, in a first prediction mode, an LSF vector for a frame is quantized independent of (e.g., with no dependency on) any prior frame LSF vector. In a second prediction mode, an LSF vector is quantized dependent on a prior frame LSF, but with a lesser dependency than in a third prediction mode. In the third prediction mode, an LSF vector is quantized dependent on a prior frame LSF with a greater dependency than in the second prediction mode.

Prediction modes may be controlled via prediction coefficients. In some configurations, for example, a current frame LSF vector may be quantized based on a prior frame LSF vector and prediction coefficients. Prediction modes with a greater dependency on the prior frame may utilize higher prediction coefficients than prediction modes with a lesser dependency. Higher prediction coefficients may weight the prior frame LSF vector higher, while lower prediction coefficients may weight the prior frame LS F vector lower in quantizing a current frame LSF vector.

The quantizer 480 may produce a prediction mode indicator 431 that indicates the prediction mode for each frame. The prediction mode indicator 431 may be sent to a decoder. In some configurations, the prediction mode indicator 431 may indicate one of two prediction modes (e.g., whether predictive quantization or non-predictive quantization is utilized) for a frame. For example, the prediction mode indicator 431 may indicate whether a frame is quantized based on a foregoing frame (e.g., predictive) or not (e.g., non-predictive). In other configurations, the prediction mode indicator 431 may indicate one of three or more prediction modes (corresponding to three or more degrees of dependency to which LSF vector quantization for a frame depends on a prior frame LSF vector).

In some configurations, the prediction mode indicator 431 may indicate the prediction mode of the current frame. In other configurations, the prediction mode indicator 431 may indicate the prediction mode of a previous frame. In yet other configurations, multiple prediction mode indicators 431 per frame may be utilized. For example, two frame prediction mode indicators 431 corresponding to a frame may be sent, where the first prediction mode indicator 431 indicates a prediction mode utilized for the current frame and a second prediction mode indicator 431 indicates a prediction mode utilized for the previous frame.

In some configurations, LSF vectors may be generated and/or quantized on a subframe basis. In some implementations, only quantized LSF vectors corresponding to certain subframes (e.g., the last or end subframe of each frame) may be sent to a decoder. In some configurations, the quantizer 480 may also determine a quantized weighting vector 429. Weighting vectors may be used to quantize LSF vectors (e.g., mid LSF vectors) between LSF vectors corresponding to the subframes that are sent (e.g., end LSF vectors). The weighting vectors may be quantized. For example, the quantizer 480 may determine an index of a codebook or lookup table corresponding to a weighting vector that best matches the actual weighting vector. The quantized weighting vectors 429 (e.g., the indices) may be sent to a decoder. The quantized LSF vector 482, the prediction mode indicator 431 and/or the quantized weighting vector 429 may be examples of the filter parameters 228 described above in connection with FIG. 2.

The quantized LSFs are provided to the synthesis filter 484. The synthesis filter 484 produces a synthesized speech signal 486 (e.g., reconstructed speech $\hat{s}(a)$) based on the quantized LSF vector 482 and an excitation signal 496. For example, the synthesis filter 484 filters the excitation signal 496 based on the quantized LSF vector 482 (e.g., $1/A(z)$).

The synthesized speech signal 486 is subtracted from the preprocessed speech signal 474 by the summer 488 to yield an error signal 490 (also referred to as a prediction error signal). The error signal 490 may represent the error between the preprocessed speech signal 474 and its estimation (e.g., the synthesized speech signal 486). The error signal 490 is provided to the perceptual weighting filter and error minimization module 492.

The perceptual weighting filter and error minimization module 492 produces a weighted error signal 493 based on the error signal 490. For example, not all of the components (e.g., frequency components) of the error signal 490 impact the perceptual quality of a synthesized speech signal equally. Error in some frequency bands has a larger impact on the speech quality than error in other frequency bands. The perceptual weighting filter and error minimization module 492 may produce a weighted error signal 493 that reduces error in frequency components with a greater impact on speech quality and distributes more error in other frequency components with a lesser impact on speech quality.

The excitation estimation module 494 generates an excitation signal 496 and an encoded excitation signal 498 based on the weighted error signal 493 from the perceptual weighting filter and error minimization module 492. For example, the excitation estimation module 494 estimates one or more parameters that characterize the error signal 490 or the weighted error signal 493. The encoded excitation signal 498 may include the one or more parameters and may be sent to a decoder. In a CELP approach, for example, the excitation estimation module 494 may determine parameters such as an adaptive (or pitch) codebook index, an adaptive (or pitch) codebook gain, a fixed codebook index and a fixed codebook gain that characterize the error signal 490 (e.g., weighted error signal 493). Based on these parameters, the excitation estimation module 494 may generate the excitation signal 496, which is provided to the synthesis filter 484. In this approach, the adaptive codebook index, the adaptive codebook gain (e.g., a quantized adaptive codebook gain), a fixed codebook index and a fixed codebook gain (e.g., a quantized fixed codebook gain) may be sent to a decoder as the encoded excitation signal 498.

The encoded excitation signal 226 may be an example of the encoded excitation signal 226 described above in connection with FIG. 2. Accordingly, the quantized LSF vector 482, the prediction mode indicator 431, the encoded excitation signal 498 and/or the quantized weighting vector 429 may be included in an encoded speech signal 106 as described above in connection with FIG. 1.

Figure 5:
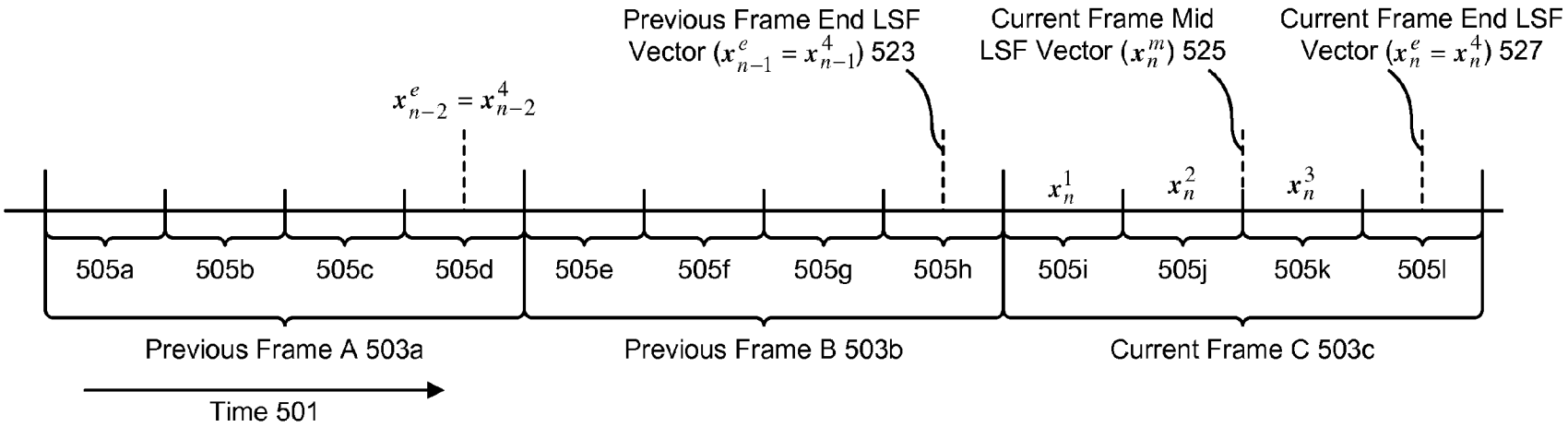
FIG. 5 is a diagram illustrating an example of frames over time.

FIG. 5 is a diagram illustrating an example of frames 503 over time 501. Each frame 503 is divided into a number of subframes 505. In the example illustrated in FIG. 5, previous frame A 503*a* includes 4 subframes 505*a-d*, previous frame B 503*b* includes 4 subframes 505*e-h* and current frame C 503*c* includes 4 subframes 505*i-l*. A typical frame 503 may occupy a time period of 20 ms and may include 4 subframes, though frames of different lengths and/or different numbers of subframes may be used. Each frame may be denoted with a corresponding frame number, where n denotes a current frame (e.g., current frame C 503*c*). Furthermore, each subframe may be denoted with a corresponding subframe number k.

FIG. 5 can be used to illustrate one example of LSF quantization in an encoder (e.g., encoder 404). Each subframe k in frame n has a corresponding LSF vector $x_n^k$, k={1, 2, 3, 4} for use in the analysis and synthesis filters. A current frame end LSF vector 527 (e.g., the last subframe LSF vector of the n-th frame) is denoted $x_n^e$, where $x_n^e=x_n^4$. A current frame mid LSF vector 525 (e.g., the mid LSF vector of the n-th frame) is denoted $x_n^m$. A "mid LSF vector" is an LSF vector between other LSF vectors (e.g., between $x_{n-1}^e$ and $x_n^e$) in time 501. One example of a previous frame end LSF vector 523 is illustrated in FIG. 5 and is denoted $x_{n-1}^e$, where $x_{n-1}^e=x_{n-1}^4$. As used herein, the term "previous frame" may refer to any frame before a current frame (e.g., n−1, n−2, n−3, etc.). Accordingly, a "previous frame end LSF vector" may be an end LSF vector corresponding to any frame before the current frame. In the example illustrated in FIG. 5, the previous frame end LSF vector 523 corresponds to the last subframe 505*h* of previous frame B 503*b* (e.g., frame n−1), which immediately precedes current frame C 503*c* (e.g., frame n).

Each LSF vector is M dimensional, where each dimension of the LSF vector corresponds to a single LSF value. For example, M is typically 16 for wideband speech (e.g., speech sampled at 16 kHz). The i-th LSF dimension of the k-th subframe of frame n is denoted as $x_{i,n}^k$, where i={1, 2, . . . , M}.

In the quantization process of frame n, the end LSF vector $x_n^e$ may be quantized first. This quantization can either be non-predictive (e.g., the previous frame end LSF vector $x_{n-1}^e$ not used in the quantization process) or predictive (e.g., the previous frame end LSF vector $x_{n-1}^e$ used in the quantization process). As described above, two or more prediction modes may be utilized. A mid LSF vector $x_n^m$ may then be quantized. For example, an encoder may select a weighting vector such that $x_{i,n}^m$ is as provided in Equation (1).

$$x_{i,n}^m=w_{i,n}\cdot x_{i,n}^e+(1-w_{i,n})\cdot x_{i,n-1}^e \quad (1)$$

The i-th dimension of the weighting vector $w_n$ corresponds to a single weight and is denoted by $w_{i,n}$, where i={1, 2, . . . , M}. It should also be noted that $w_{i,n}$ is not constrained. In particular, if $0\le w_{i,n}\le 1$ yields a value (e.g., an interpolation) bounded by $x_{i,n}^e$ and $w_{i,n-1}^e$ and $w_{i,n}<0$ or $w_{i,n}>1$, the resulting mid LSF vector $x_n^m$ might be outside the range $[x_{i,n}^e\ x_{n-1}^e]$ (e.g., an extrapolation based on $x_{i,n}^e$ and $w_{i,n-1}^e$). An encoder may determine (e.g., select) a weighting vector $w_n$ such that the quantized mid LSF vector is closest to the actual mid LSF value in the encoder based on some distortion measure, such as mean squared error (MSE) or log spectral distortion (LSD). In the quantization process, the encoder transmits the quantization indices of the current frame end LSF vector $x_n^e$ and the index of the weighting vector $w_n$, which enables a decoder to reconstruct $x_n^e$ and $x_n^m$.

The subframe LSF vectors $x_n^k$ may be interpolated based on $x_{i,n-1}^e$, $x_{i,n}^m$ and $x_{i,n}^e$ using interpolation factors $\alpha_k$ and $\beta_k$ as given by Equation (2).

$$x_n^k=\alpha_k\cdot x_n^e+\cdot\beta_k\cdot x_{n-1}^e+(1-\alpha_k-\beta_k)\cdot x_n^m \quad (2)$$

It should be noted that $\alpha_k$ and $\beta_k$ may be such that $0\le(\alpha_k,\beta_k)\le 1$. The interpolation factors $\alpha_k$ and $\beta_k$ may be predetermined values known to both the encoder and decoder.

Because LSF vectors in the current frame depend on the previous frame end LSF vector $x_{n-1}^e$, the speech quality of the current frame may be adversely affected when the previous frame end LSF vector is estimated (e.g., when a frame erasure occurs). For example, the current frame mid LSF vector $x_n^m$ and subframe LSF vectors $x_n^k$ of the current frame (except for $x_n^e$, for instance) may be interpolated based on an estimated previous frame end LSF vector. This may result in mismatched synthesis filter coefficients between the encoder and decoder, which may produce artifacts in the synthesized speech signal.

Figure 6:
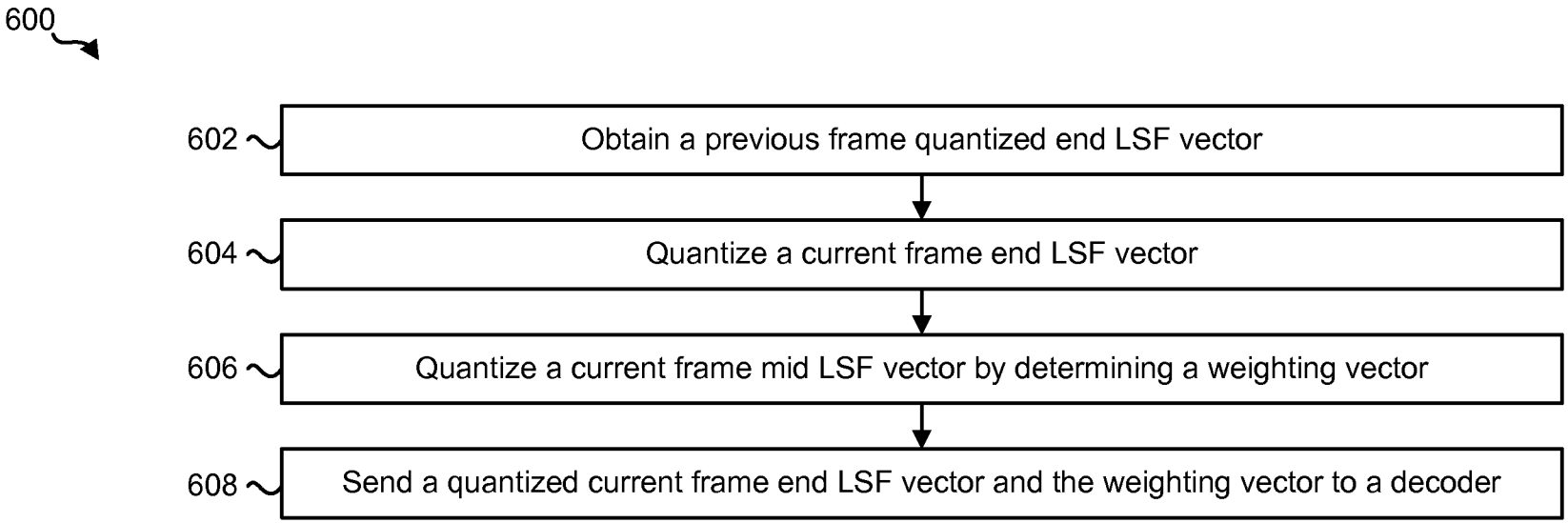
FIG. 6 is a flow diagram illustrating one configuration of a method for encoding a speech signal by an encoder.

FIG. 6 is a flow diagram illustrating one configuration of a method 600 for encoding a speech signal 402 by an encoder 404. For example, an electronic device including an encoder 404 may perform the method 600. FIG. 6 illustrates LSF quantizing procedures for a current frame n.

The encoder 404 may obtain 602 a previous frame quantized end LSF vector. For example, the encoder 404 may quantize an end LSF corresponding to a previous frame (e.g., $x_{n-1}^e$) by selecting a codebook vector that is closest to the end LSF corresponding to the previous frame n−1.

The encoder 404 may quantize 604 a current frame end LSF vector (e.g., $x_n^e$). The encoder 404 quantizes 604 the current frame end LSF vector based on the previous frame end LSF vector if predictive LSF quantization is used. However, quantizing 604 the current frame LSF vector is not based on the previous frame end LSF vector if non-predictive quantization is used for the current frame end LSF.

The encoder 404 may quantize 606 a current frame mid LSF vector (e.g., $x_n^m$) by determining a weighting vector (e.g., $w_n$). For example, the encoder 404 may select a weighting vector that results in a quantized mid LSF vector that is closest to the actual mid LSF vector. As illustrated in Equation (1), the quantized mid LSF vector may be based on the weighting vector, the previous frame end LSF vector and the current frame end LSF vector.

The encoder 404 may send 608 a quantized current frame end LSF vector and the weighting vector to a decoder. For example, the encoder 404 may provide the current frame end LSF vector and the weighting vector to a transmitter on an electronic device, which may transmit them to a decoder on another electronic device.

Some configurations of the systems and methods disclosed herein provide approaches for determining LSF interpolation factors based on one or more current frame properties and one or more previous frame properties. For example, the systems and methods disclosed herein may be applied in a speech coding system that operates in impaired channel conditions. Some speech coding systems perform interpolation and/or extrapolation of LSFs between current frame LSFs and previous frame LSFs on a subframe basis. However, speech artifacts can result under frame erasure conditions, depending on an LSF vector estimated due to an erased frame, where the estimated LSF vector is utilized to generate subframe LSF vectors for a correctly received frame.

Figure 7:
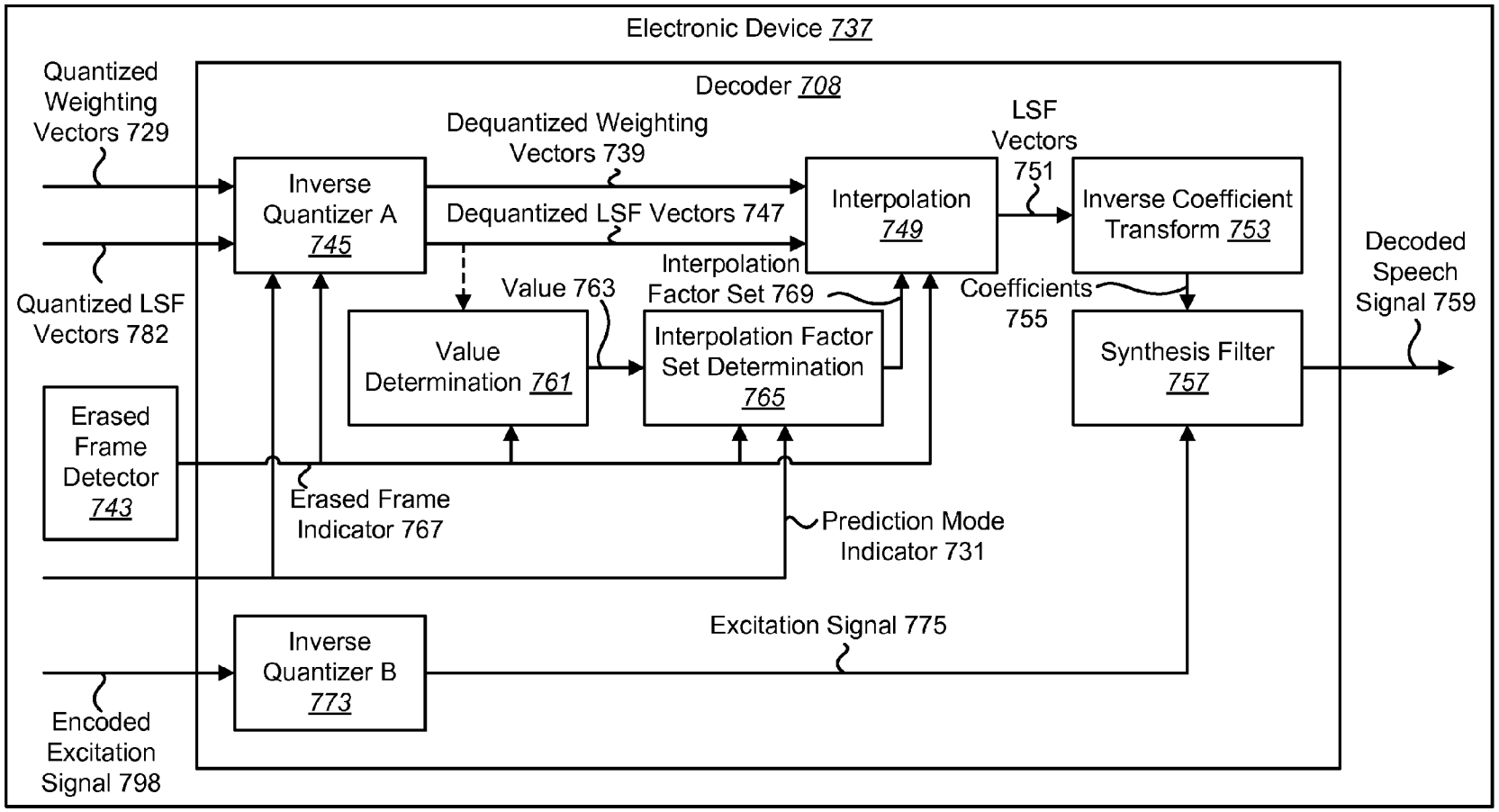
FIG. 7 is a block diagram illustrating one configuration of an electronic device configured for determining an interpolation factor set.

FIG. 7 is a block diagram illustrating one configuration of an electronic device 737 configured for determining an interpolation factor set. The electronic device 737 includes a decoder 708. The decoder 708 produces a decoded speech signal 759 (e.g., a synthesized speech signal) based on quantized weighting vectors 729, quantized LSF vectors 782, a prediction mode indicator 731 and/or an encoded excitation signal 798. One or more of the decoders described above may be implemented in accordance with the decoder 708 described in connection with FIG. 7. The electronic device 737 also includes an erased frame detector 743. The erased frame detector 743 may be implemented separately from the decoder 708 or may be implemented in the decoder 708. The erased frame detector 743 detects an erased frame (e.g., a frame that is not received or is received with errors) and may provide an erased frame indicator 767 when an erased frame is detected. For example, the erased frame detector 743 may detect an erased frame based on one or more of a hash function, checksum, repetition code, parity bit(s), cyclic redundancy check (CRC), etc.

It should be noted that one or more of the components included in the electronic device 737 and/or decoder 708 may be implemented in hardware (e.g., circuitry), software or a combination of both. For instance, one or more of the value determination module 761 and the interpolation factor set determination module 765 may be implemented in hardware (e.g., circuitry), software or a combination of both. It should also be noted that arrows within blocks in FIG. 7 or other block diagrams herein may denote a direct or indirect coupling between components. For example, the value determination module 761 may be coupled to the interpolation factor set determination module 765.

The decoder 708 produces a decoded speech signal 759 (e.g., a synthesized speech signal) based on received parameters. Examples of the received parameters include quantized LSF vectors 782, quantized weighting vectors 729, a prediction mode indicator 731 and an encoded excitation signal 798. The decoder 708 includes one or more of inverse quantizer A 745, an interpolation module 749, an inverse coefficient transform 753, a synthesis filter 757, a value determination module 761, an interpolation factor set determination module 765 and inverse quantizer B 773.

The decoder 708 receives quantized LSF vectors 782 (e.g., quantized LSFs, LSPs, ISFs, ISPs, PARCOR coefficients, reflection coefficients or log-area-ratio values) and quantized weighting vectors 729. The received quantized LSF vectors 782 may correspond to a subset of subframes. For example, the quantized LSF vectors 782 may only include quantized end LSF vectors that correspond to the last subframe of each frame. In some configurations, the quantized LSF vectors 782 may be indices corresponding to a look up table or codebook. Additionally or alternatively, the quantized weighting vectors 729 may be indices corresponding to a look up table or codebook.

The electronic device 737 and/or the decoder 708 may receive the prediction mode indicator 731 from an encoder. As described above, the prediction mode indicator 731 indicates a prediction mode for each frame. For example, the prediction mode indicator 731 may indicate one of two or more prediction modes for a frame. More specifically, the prediction mode indicator 731 may indicate whether predictive quantization or non-predictive quantization is utilized and/or a degree of dependency to which LSF vector quantization for a frame depends on a prior frame LSF vector. As described above in connection with FIG. 4, the prediction mode indicator 731 may indicate one or more prediction modes corresponding to a current frame (e.g., frame n) and/or a previous frame (e.g., frame n−1).

When a frame is correctly received, inverse quantizer A 745 dequantizes the received quantized LSF vectors 729 to produce dequantized LSF vectors 747. For example, inverse quantizer A 745 may look up dequantized LSF vectors 747 based on indices (e.g., the quantized LSF vectors 782) corresponding to a look up table or codebook. Dequantizing the quantized LSF vectors 782 may also be based on the prediction mode indicator 731. The dequantized LSF vectors 747 may correspond to a subset of subframes (e.g., end LSF vectors $x_n^e$ corresponding to the last subframe of each frame). Furthermore, inverse quantizer A 745 dequantizes the quantized weighting vectors 729 to produce dequantized weighting vectors 739. For example, inverse quantizer A 745 may look up dequantized weighting vectors 739 based on indices (e.g., the quantized weighting vectors 729) corresponding to a look up table or codebook.

When a frame is an erased frame, the erased frame detector 743 may provide an erased frame indicator 767 to inverse quantizer A 745. When an erased frame occurs, one or more quantized LSF vectors 782 and/or one or more quantized weighting vectors 729 may not be received or may contain errors. In this case, inverse quantizer A 745 may estimate one or more dequantized LSF vectors 747 (e.g., an end LSF vector of the erased frame $\hat{x}_n^e$) based on one or more LSF vectors from a previous frame (e.g., a frame before the erased frame). Additionally or alternatively, inverse quantizer A 745 may estimate one or more dequantized weighting vectors 739 when an erased frame occurs. The dequantized LSF vectors 747 (e.g., end LSF vectors) may be provided to the interpolation module 749 and optionally to the value determination module 761.

The value determination module 761 determines a value 763 based on a current frame property and a previous frame property. The value 763 is a metric that indicates a degree of change between a previous frame property and a current frame property. Examples of frame properties include synthesis filter impulse energy (e.g., synthesis filter gain), reflection coefficients and spectral tilts. Abrupt changes in frame properties may be atypical in speech and may lead to artifacts in the synthesized speech signal if left unaddressed. Accordingly, the value 763 may be utilized to address potential artifacts in case of a frame erasure.

In some configurations, the value 763 may be an energy ratio. For example, the value determination module 761 may determine an energy ratio (e.g., R) of a current frame synthesis filter impulse response energy (e.g., $E_n$) and a previous frame synthesis filter impulse response energy (e.g., $E_{n-1}$).

In one approach, the value determination module 761 may determine an energy ratio as follows. The value determination module 761 may obtain a current frame end LSF vector (e.g., $x_n^e$) and a previous frame end LSF vector (e.g., $x_{n-1}^e$) from the dequantized LSF vectors 747. The value determination module 761 may perform an inverse coefficient transform on the current frame end LSF vector and a previous frame end LSF vector to obtain a current frame end synthesis filter (e.g., $$\frac{1}{A_n^e(z)})$$

and a previous frame end synthesis filter (e.g., $$\frac{1}{A_{n-1}^e(z)}),$$

respectively. The value determination module 761 may determine the impulse responses of the current frame end synthesis filter and the previous frame end synthesis filter. For example, the impulse responses of the synthesis filters corresponding to $x_{n-1}^e$ and $x_n^e$ may be respectively denoted $h_{n-1}(i)$ and $h_n(i)$, where i is a sample index of the impulse response. It should be noted that the impulse responses (e.g., $h_{n-1}(i)$ and $h_n(i)$) may be truncated, since the current frame end synthesis filter and the previous frame end synthesis filter are infinite impulse response (IIR) filters.

A current frame synthesis filter impulse energy is one example of a current frame property. Additionally, a previous frame synthesis filter impulse response energy is one example of a previous frame property. In some configurations, the value determination module 761 may determine the current frame synthesis filter impulse energy (e.g., $E_n$) and the previous frame synthesis filter impulse response energy (e.g., $E_{n-1}$) in accordance with Equation (3).

$$E_n = \sum_{i}^{N} h_n^2(i) \tag{3}$$

In Equation (3), i is the sample index and N is the length of the truncated impulse response $h_n(i)$. As illustrated by Equation (3), the current frame synthesis filter impulse energy and the previous frame synthesis filter impulse response energy may be truncated. In some configurations, N may be 128 samples. The synthesis filter impulse response energies (e.g., $E_n$ and $E_{n-1}$) may be estimates of gains of the corresponding synthesis filters (that are based on LSF vectors $x_n^e$ and $x_{n-1}^e$, for example).

The value determination module 761 may determine the energy ratio between the current frame synthesis filter impulse energy (e.g., $E_n$) and the previous frame synthesis filter impulse response energy (e.g., $E_{n-1}$) in accordance with Equation (4).

$$R = \frac{E_n}{E_{n-1}} \tag{4}$$

In some configurations, the value 763 may be multidimensional. For example, the value determination module 761 may determine a value 763 as a set of reflection coefficients. For instance, the value determination module 761 may determine a current frame first reflection coefficient (e.g., $R0_n$) and a previous frame first reflection coefficient (e.g., $R0_{n-1}$). In some configurations, one or more of the reflection coefficients may be derived from one or more LSF vectors (e.g., dequantized LSF vectors 747) and/or linear prediction coefficient vectors. For example, the reflection coefficients may be based on LPC coefficients. The value 763 may include the current frame first reflection coefficient and the previous frame first reflection coefficient. Accordingly, the value 763 may indicate a change (if any) between a current frame first reflection coefficient (e.g., $R0_n$) and a previous frame first reflection coefficient (e.g., $R0_{n-1}$). In other configurations, the value 763 may include one or more spectral tilts of each frame, which may be determined as a ratio of high band (e.g., upper half of a spectral range) energy to low band (e.g., lower half of a spectral range) energy.

The value 763 may be provided to the interpolation factor set determination module 765. The interpolation factor set determination module 765 may determine whether the value 763 (e.g., an energy ratio, reflection coefficients or spectral tilts) is outside of a range. The range specifies a domain of values 763 that are characteristic of regular speech. For example, the range may separate values 763 that typically occur in regular speech from values 763 that do not occur and/or are rare in regular speech. For instance, values 763 that are outside of the range may indicate frame characteristics that occur in conjunction with an erased frame and/or inadequate frame erasure concealment. Accordingly, the interpolation factor set determination module 765 may determine whether a frame exhibits characteristics that do not occur or that are rare in regular speech based on the value 763 and the range.

In some configurations, the range may be multidimensional. For example, the range may be defined in two or more dimensions. In these configurations, a multidimensional value 763 may be outside of the range if each value 763 dimension is outside of each range dimension. It should be noted that determining whether the value 763 is outside of a range (e.g., a first range) may equivalently mean determining whether the value 763 is within another range (e.g., a complement of the first range).

The range may be based on one or more thresholds. In one example, a single threshold may separate values 763 inside of the range from values 763 outside of the range. For instance, all values 763 above the threshold may be inside of the range and all values 763 below the threshold may be outside of the range. Alternatively, all values 763 below the threshold may be inside of the range and all values 763 above the threshold may be outside of the range. In another example, two thresholds may separate values 763 inside of the range from values 763 outside of the range. For instance, all values 763 between the thresholds may be inside of the range, while all values 763 that are below the lower threshold and above the higher threshold may be outside of the range. Alternatively, all values 763 between the thresholds may be outside of the range, while all values 763 that are below the lower threshold and above the higher threshold may be inside of the range. As illustrated by these examples, the range may be continuous or discontinuous. In additional examples, more than two thresholds may be utilized. In some configurations, a multidimensional range may be based on at least two thresholds, where a first threshold corresponds to one dimension of the range and a second threshold corresponds to another dimension of the range.

In some configurations, the interpolation factor set determination module 765 may determine whether the value 763 is outside of the range by determining whether the energy ratio (R) is less than one or more thresholds and/or greater than one or more thresholds. In other configurations, the interpolation factor set determination module 765 may determine whether the value 763 is outside of the range by determining whether the change between the first reflection coefficient (R0) (or spectral tilt, for example) of a previous frame and a current frame is outside of a multidimensional range. For example, the electronic device 737 may determine whether the previous frame first reflection coefficient (e.g., $R0_{n-1}$) is greater than a first threshold and the current frame first reflection coefficient (e.g., $R0_n$) is less than a second threshold.

If the value 763 is not outside of the range, the interpolation factor set determination module 765 may utilize a default interpolation factor set. The default interpolation factor set may be a fixed interpolation factor set that is used when no frame erasure has occurred (e.g., in clean channel conditions). For example, the interpolation factor set determination module 765 may provide a default interpolation factor set as the interpolation factor set 769 when the value 763 in not outside of the range.

The interpolation factor set determination module 765 may determine an interpolation factor set 769. For example, the interpolation factor set determination module 765 may determine an interpolation factor set 769 based on the value 763 and a prediction mode indicator 731 if the value 763 is outside of the range. An interpolation factor set is a set of two or more interpolation factors. For example, an interpolation factor set may include interpolation factors $\alpha$ and $\beta$. In some configurations, an interpolation factor set may include a difference factor that is based on other interpolation factors in the interpolation factor set. For example, an interpolation factor set may include interpolation factors $\alpha$, $\beta$ and a difference factor $1-\alpha-\beta$. In some configurations, an interpolation factor set may include two or more interpolation factors for one or more subframes. For example, an interpolation factor set may include $\alpha_k$, $\beta_k$ and a difference factor $1-\alpha_k-\beta_k$ for the k-th subframe, where $k=\{1, \ldots, K\}$ and K is a number of subframes in a frame. The interpolation factors (and the difference factor, for example) are utilized to interpolate dequantized LSF vectors 747.

If the value 763 is outside of the range, the interpolation factor set determination module 765 may determine (e.g., select) the interpolation factor set 769 from a group of interpolation factor sets based on the value 763 and the prediction mode indicator 731. For example, the systems and methods disclosed herein may provide an adaptive mechanism to switch between predefined interpolation factor sets (e.g., different sets of $\alpha$ and $\beta$) based on the value 763 and the prediction mode indicator 731.

It should be noted that some known approaches only utilize a fixed interpolation factor. For example, one known approach provided by Enhanced Variable Rate Codec B (EVRC-B) specifications may only utilize one fixed interpolation factor. In approaches that use fixed interpolation, the interpolation factor(s) may not change or may not be adapted. In accordance with the systems and methods disclosed herein, however, the electronic device 737 may adaptively determine different interpolation factor sets (e.g., adaptively select an interpolation factor set from a group of multiple interpolation factor sets) based on the value 763 and/or the prediction mode indicator 731. In some cases, a default interpolation factor set may be utilized. The default interpolation factor set may be the same as an interpolation factor set that is utilized in the clean channel case (without an erased frame, for example). The systems and methods disclosed herein may detect cases for deviating from the default interpolation factor set.

The systems and methods disclosed herein may provide the benefits of greater flexibility when handling potential artifacts caused by frame erasures. Another benefit of the systems and methods disclosed herein may be that no additional signaling may be required. For example, no additional signaling may be needed beyond the prediction mode indicator 731, the quantized LSF vectors 782 and/or the encoded excitation signal 798 to implement the systems and methods disclosed herein.

In some configurations, determining the interpolation factor set 769 may be based on one or more thresholds outside of the range. For example, different interpolation factor sets may be determined based on the degree to which the value 763 is outside of the range as determined based on one or more thresholds outside of the range. In other configurations, no thresholds outside of the range may be utilized. In these configurations, only one or more thresholds that bound the range may be utilized. For instance, the interpolation factor set 769 may be determined based on the value 763 being anywhere outside of the range and based on the prediction mode indicator 731. Determining the interpolation factor set 769 may be accomplished in accordance with one or more approaches. Examples of some approaches are given as follows.

In one approach, the interpolation factor set determination module 765 may determine an interpolation factor set 769 (e.g., $\alpha_k$, $\beta_k$ and $1-\alpha_k-\beta_k$) based on the energy ratio (e.g., R). In particular, if R is outside of the range, it may be assumed that the end LSF of the erased frame (e.g., frame n−1) is incorrectly estimated. Hence, a different set of $\alpha_k$, $\beta_k$ and $1-\alpha_k-\beta_k$ may be picked such that more interpolation weight is given to the current frame (e.g., a correctly received frame) end LSF vector $x_n^e$. This may help to reduce artifacts in the synthesized speech signal (e.g., decoded speech signal 759).

In conjunction with the energy ratio (R), the prediction mode indicator 731 may also be utilized in some configurations. The prediction mode indicator 731 may correspond to the current frame (e.g., to the current frame end LSF vector $x_n^e$ quantization). In this approach, the interpolation factor set may be determined based on whether a frame prediction mode is predictive or non-predictive. If the current frame (e.g., frame n) utilizes non-predictive quantization, it may be assumed that the current frame end LSF $x_n^e$ is correctly quantized. Thus, higher interpolation weight may be given to the current frame end LSF $x_n^e$ compared to the case where the current frame end LSF $x_n^e$ is quantized with predictive quantization. Accordingly, the interpolation factor set determination module 765 utilizes the energy ratio (R) and whether the current frame utilizes predictive or non-predictive quantization (e.g., the predictive or non-predictive nature of the frame n LS F quantizer) to determine the interpolation factor set 769 in this approach.

Listing (1) below illustrates examples of interpolation factor sets that may be used in this approach. The interpolation factor set determination module 765 may determine (e.g., select) one of the interpolation factor sets based on the value 763 and the prediction mode indicator 731. In some configurations, the interpolation factors may transition from previous frame LSF vector dependency to increased current frame LSF vector dependency. The interpolation factors (e.g., weighting factors) are given in Listing (1), where each row is ordered as $\beta_k$, $1-\alpha_k-\beta_k$ and $\alpha_k$, where each row corresponds to each subframe k and $k=\{1, 2, 3, 4\}$. For example, the first row of each interpolation factor set includes interpolation factors for the first subframe, the second row includes interpolation factors for the second subframe and so on. For instance, if Interpolation_factor_set_A is determined as the interpolation factor set 769, the interpolation module 749 applies $\alpha_1=0.30$, $\beta_1=0.00$ and $1-\alpha_1-\beta_1=0.70$ for the first subframe in accordance with Equation (2) in the interpolation process. It should be noted that the interpolation factor sets given in Listing (1) are examples. Other sets of interpolation factors may be utilized in accordance with the systems and methods disclosed herein.

Listing (1)

```
Interpolation_factor_set_A ={0.00, 0.70, 0.30,
0.00, 0.00, 1.00,
0.00, 0.00, 1.00,
0.00, 0.00, 1.00};
Interpolation_factor_set_B ={0.15, 0.70, 0.15,
0.05, 0.65, 0.30,
0.00, 0.50, 0.50,
0.00, 0.0, 1.00};
Interpolation_factor_set_C ={0.10, 0.70, 0.20,
0.00, 0.30, 0.70,
0.00, 0.10, 0.90,
0.00, 0.00, 1.00};
Interpolation_factor_set_D ={0.30, 0.50, 0.20,
0.15, 0.65, 0.20,
0.05, 0.55, 0.40,
0.00, 0.00, 1.00};
```

-continued

Listing (1)

```
Interpolation_factor_set_E ={0.55, 0.45, 0.00,
0.05, 0.95, 0.00,
0.00, 0.55, 0.45,
0.00, 0.00, 1.00};
```

In Listing (2), one interpolation factor set 769 (e.g., "pt_int_coeffs") may be determined by selecting one of the interpolation factor sets from Listing (1) based on the energy ratio (R) (e.g., the value 763) and the prediction mode indicator 731 for the current frame (e.g., "frame_n_mode"). For example, an interpolation factor set 769 may be determined based on whether a current frame prediction mode is non-predictive or predictive and based on two thresholds (e.g., TH1, TH2) that may be utilized to determine whether and to what degree R is outside a range. In Listing (2), the range may be defined as R≥TH2.

Listing (2)

```
    if ((R<TH1) && (frame_n_mode == non-predictive))
        pt_int_coeffs = Interpolation_factor_set_A;
else if ((R<TH1) && (frame_n_mode == predictive))
        pt_int_coeffs = Interpolation_factor_set_B;
else if ((R<TH2) && (frame_n_mode == non-predictive))
        /*R is between TH1 and TH2 and non-predictive quantization
        is utilized*/
        pt_int_coeffs = Interpolation_factor_set_C;
else if (R<TH2) && (frame_n_mode == predictive))
        /*R is between TH1 and TH2 and predictive quantization is
        utilized*/
        pt_int_coeffs = Interpolation_factor_set_D;
    else /* default */
        pt_int_coeffs = Interpolation_factor_set_E;
```

Listing (2) accordingly illustrates one example of determining whether the value is outside a range and determining an interpolation factor set based on the value and a frame prediction mode if the value is outside the range. As illustrated in Listing (2), a default interpolation factor set (e.g., Interpolation_factor_set_E) may be utilized if the value is not outside the range. In Listing (2), one of interpolation factor sets A-D may be determined adaptively based on the degree to which R is outside of the range. Specifically, Interpolation_factor_set_D may be selected if R is outside of the range (e.g., R<TH2) and Interpolation_factor_set_B may be selected if R is outside of the range to a greater degree (e.g., R<TH1). Accordingly, TH1 is one example of a threshold outside of the range. Listing (2) also illustrates Interpolation_factor_set_E as a default interpolation factor set to be utilized when R is not outside the range. In one example, TH1=0.3 and TH2=0.5.

In another approach, an interpolation factor set may be determined based on the previous frame first reflection coefficient (e.g., $R0_{n-1}$) and the current frame first reflection coefficient (e.g., $R0_n$) and/or the prediction mode indicator 731. For example, if the previous frame first reflection coefficient is greater than a first threshold (e.g., $R0_{n-1}$>TH1) and the current frame first reflection coefficient is less than a second threshold (e.g., $R0_n$<TH2), then a different interpolation factor set may be determined. For instance, $R0_{n-1}$>TH1 may indicate a highly unvoiced previous frame, while $R0_n$<TH2 may indicate a highly voiced current frame. In this case, the interpolation factor set determination module 765 may determine an interpolation factor set 769 that reduces the dependency of the highly unvoiced frame (e.g., frame n−1). Additionally, the prediction mode indicator 731 may be utilized in conjunction with the first reflection coefficients to determine an interpolation factor set 769 similar to the previous approach as illustrated in Listing (2).

In some configurations, the interpolation factor set determination module 765 may additionally or alternatively determine the interpolation factor set 769 based on a previous frame prediction mode. For example, the previous frame prediction mode may be side information sent in a current frame (e.g., frame n) regarding the frame prediction mode (e.g., predictive or non-predictive LSF quantization) of a previous frame (e.g., an erased frame n-1). For example, if the prediction mode indicator 731 indicates that LSF quantization for frame n-1 was non-predictive, then the interpolation factor set determination module 765 may select Interpolation_factor_set_A in Listing (1) with the least dependency on the previous frame LSF vector. This is because the estimated previous frame end LSF vector $\hat{x}_{n-1}^{e}$ (which may be estimated via extrapolation based on frame erasure concealment, for example) may be quite different from the actual previous frame end LSF vector $x_{n-1}^{e}$. It should be noted that the previous frame prediction mode may be one of two or more prediction modes that indicate a degree of dependency to which LSF vector quantization for the previous frame depends on a prior frame LSF vector.

In some configurations, the operation of the value determination module 761 and/or the interpolation factor set determination module 765 may be conditioned on the erased frame indicator 767. For example, the value determination module 761 and the interpolation factor set determination module 765 may only operate for one or more frames after an erased frame is indicated. While the interpolation factor set determination module 765 is not operating, the interpolation module 749 may utilize a default interpolation factor set. In other configurations, the value determination module 761 and the interpolation factor set determination module 765 may operate for every frame, regardless of frame erasures.

The dequantized LSF vectors 747 and dequantized weighting vectors 739 may be provided to the interpolation module 749. The interpolation module 749 may determine a current frame mid LSF vector (e.g., $x_n^m$) based on the dequantized LSF vectors 747 (e.g., a current frame end LSF vector $x_n^e$ and a previous frame end LSF vector $x_{n-1}^e$) and a dequantized weighting vector 739 (e.g., a current frame weighting vector $w_n$). This may be accomplished in accordance with Equation (1), for example.

The interpolation module 749 interpolates the dequantized LSF vectors 747 and the current frame mid LSF vector based on the interpolation factor set 769 in order to generate subframe LS F vectors (e.g., subframe LSF vectors $x_n^k$ for the current frame). For example, the interpolation module 749 may interpolate the subframe LSF vectors $x_n^k$ based on $x_{i,n-1}^e$, $x_{i,n}^m$ and $x_{i,n}^e$ using interpolation factors $\alpha_k$ and $\beta_k$ in accordance with the equation $x_n^k=\alpha_k \cdot x_n^e+\cdot\beta_k \cdot x_{n-1}^e+(1-\alpha_k-\beta_k)\cdot x_n^m$. The interpolation factors $\alpha_k$ and $\beta_k$ may be such that $0\leq(\alpha_k, \beta_k)\leq 1$. Here, k is an integer subframe number, where $1\leq k\leq K-1$, where K is the total number of subframes in the current frame. The interpolation module 749 accordingly interpolates LSF vectors corresponding to each subframe in the current frame.

The interpolation module 749 provides LSF vectors 751 to the inverse coefficient transform 753. The inverse coefficient transform 753 transforms the LSF vectors 751 into coefficients 755 (e.g., filter coefficients for a synthesis filter 1/A (z)). The coefficients 755 are provided to the synthesis filter 757.

Inverse quantizer B 773 receives and dequantizes an encoded excitation signal 798 to produce an excitation signal 775. In one example, the encoded excitation signal 798 may include a fixed codebook index, a quantized fixed codebook gain, an adaptive codebook index and a quantized adaptive codebook gain. In this example, inverse quantizer B 773 looks up a fixed codebook entry (e.g., vector) based on the fixed codebook index and applies a dequantized fixed codebook gain to the fixed codebook entry to obtain a fixed codebook contribution. Additionally, inverse quantizer B 773 looks up an adaptive codebook entry based on the adaptive codebook index and applies a dequantized adaptive codebook gain to the adaptive codebook entry to obtain an adaptive codebook contribution. Inverse quantizer B 773 may then sum the fixed codebook contribution and the adaptive codebook contribution to produce the excitation signal 775.

The synthesis filter 757 filters the excitation signal 775 in accordance with the coefficients 755 to produce a decoded speech signal 759. For example, the poles of the synthesis filter 757 may be configured in accordance with the coefficients 755. The excitation signal 775 is then passed through the synthesis filter 757 to produce the decoded speech signal 759 (e.g., a synthesized speech signal).

Figure 8:
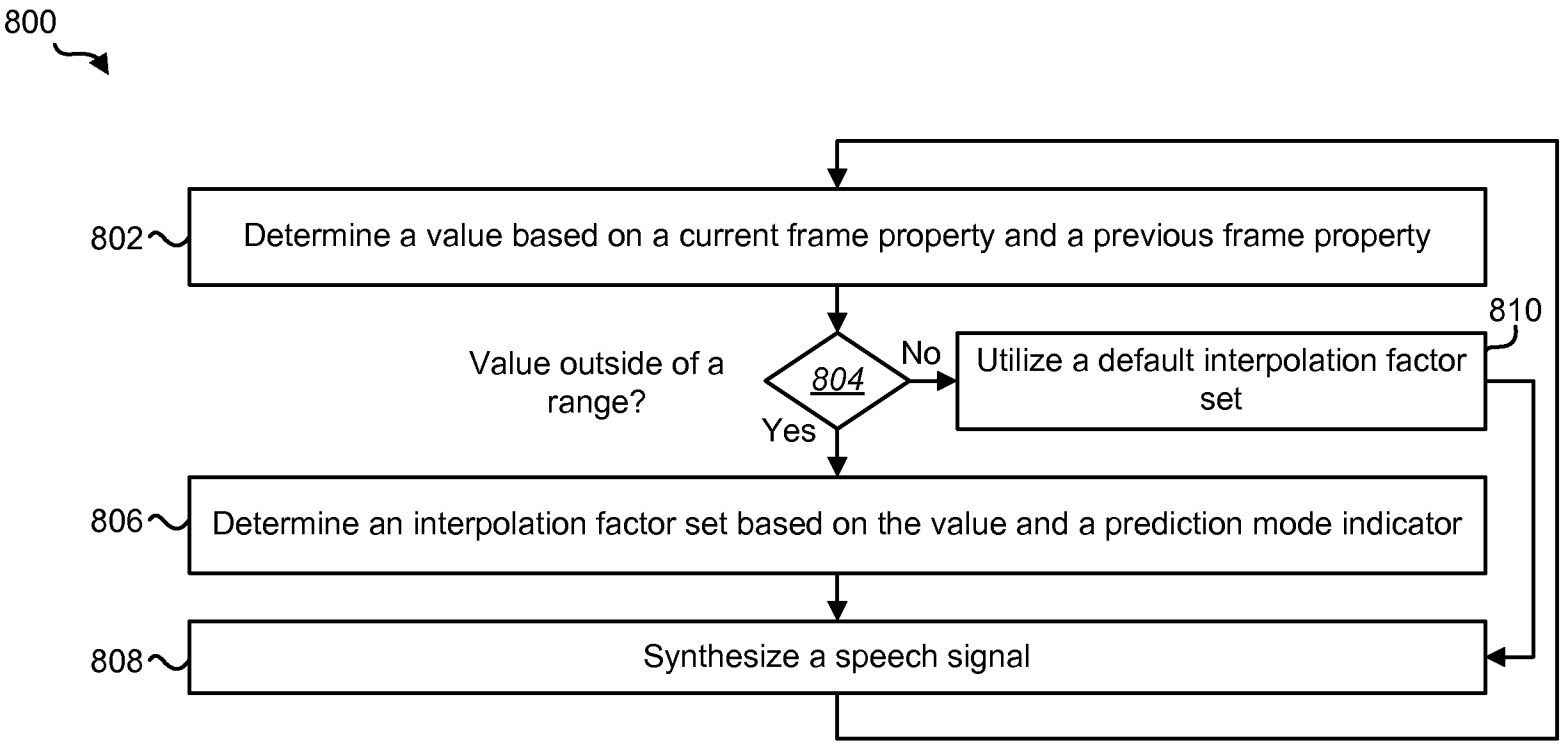
FIG. 8 is a flow diagram illustrating one configuration of a method for determining an interpolation factor set by an electronic device.

FIG. 8 is a flow diagram illustrating one configuration of a method 800 for determining an interpolation factor set by an electronic device 737. The electronic device 737 may determine 802 a value 763 based on a current frame property and a previous frame property. In one example, the electronic device 737 may determine an energy ratio based on a current frame synthesis filter impulse response energy and a previous frame synthesis filter impulse response energy as described in connection with FIG. 7. In other examples, the electronic device 737 may determine a value 763 as multiple reflection coefficients or spectral tilts as described above in connection with FIG. 7.

The electronic device 737 may determine 804 whether the value 763 is outside of a range. For example, the electronic device 737 may determine 804 whether the value 763 is outside of a range based on one or more thresholds as described above in connection with FIG. 7. For instance, the electronic device 737 may determine 804 whether an energy ratio (R) is less than one or more thresholds and/or greater than one or more thresholds. Additionally or alternatively, the electronic device 737 may determine 804 whether a previous frame first reflection coefficient (e.g., $R0_{n-1}$) is greater than a first threshold and a current frame first reflection coefficient (e.g., $R0_n$) is less than a second threshold.

If the value 763 is not outside of the range (e.g., inside of the range), the electronic device 737 may utilize 810 a default interpolation factor set. For example, the electronic device 737 may apply the default interpolation factor set to interpolate subframe LSFs based on a previous frame end LSF vector, a current frame mid LSF vector and a current frame end LSF vector.

If the value is outside of the range, the electronic device 737 may determine 806 an interpolation factor set 769 based on the value 763 and a prediction mode indicator 731. For example, if the value 763 is outside of the range, the electronic device 737 may determine 806 (e.g., select) the interpolation factor set 769 from a group of interpolation factor sets based on the value 763 and the prediction mode indicator 731 as described above in connection with FIG. 7. For instance, different interpolation factor sets may be determined 806 based on a prediction mode (e.g., current frame prediction mode and/or a previous frame prediction mode) and/or based on the degree to which the value 763 is outside of the range as determined based on one or more thresholds outside of the range. In some configurations, the interpolation factor set that is determined 806 when the value is outside of the range may not be the default interpolation factor set.

The electronic device 737 may interpolate subframe LSF vectors based on the interpolation factor set 769 as described above in connection with FIG. 7. For example, interpolating subframe LSF vectors based on the interpolation factor set 769 may include multiplying a current frame end LSF vector (e.g., $x_n^e$) by a first interpolation factor (e.g., $\alpha_k$), multiplying a previous frame end LSF vector (e.g., $x_{n-1}^e$) by a second interpolation factor (e.g., $\beta_k$) and multiplying a current frame mid LSF vector (e.g., $x_n^m$) by a difference factor (e.g., $(1-\alpha_k-\beta_k)$). This may be repeated for corresponding interpolation factors (e.g., $\alpha_k$ and $\beta_k$) for each subframe k in a frame. This may be accomplished in accordance with Equation (2), for example.

The electronic device 737 may synthesize 808 a speech signal. For example, the electronic device 737 may synthesize a speech signal by passing an excitation signal 775 through a synthesis filter 757 as described above in connection with FIG. 7. The coefficients 755 of the synthesis filter 757 may be based on LSF vectors 751 that are interpolated based on the interpolation factor set 769. In some configurations and/or instances, the method 800 may be repeated for one or more frames.

It should be noted that one or more of the steps, functions or procedures described in connection with FIG. 8 may be combined in some configurations. For example, some configurations of the electronic device 737 may determine 804 whether the value 763 is outside of the range and determine 806 an interpolation factor set based on the value and the prediction mode indicator 731 as part of the same step. It should also be noted that one or more of the steps, functions or procedures may be divided into multiple steps, functions or procedures in some configurations.

It should be noted that Enhanced Variable Rate Codec B (EVRC-B) may utilize an approach to terminate dependency on the previous frame LSF vector using the variation of the first reflection coefficient between the current frame (e.g., frame n) and the previous frame (e.g., frame n−1). However, the systems and methods disclosed herein are different from that approach for at least the following reasons.

The known approach completely removes the dependency of the estimated previous frame end LSF vector $\hat{x}_{n-1}^e$ corresponding to the erased frame. However, some configurations of the systems and methods disclosed herein utilize the estimated previous frame end LSF $\hat{x}_{n-1}^e$ corresponding to the erased frame. Additionally, some configurations of the systems and methods disclosed herein utilize adaptive interpolation techniques for smoother recovery. For example, an interpolation factor set may be adaptively determined, rather than simply utilizing a default interpolation factor set. Additionally, some configurations of the systems and methods disclosed herein utilize a mid LSF vector (e.g., $x_n^m$) in addition to the previous frame end LSF vector $x_{n-1}^e$ and the current frame end LSF vector $x_n^e$ in the LSF interpolation process.

Some configurations of the systems and methods disclosed herein utilize the current frame prediction mode (as indicated by a prediction mode indicator, for example) in the LSF interpolation factor set determination process. Known approaches may only depend on the type of the frame (by using a first reflection coefficient, for example), whereas the systems and methods disclosed herein may utilize frame properties as well as the possibility of error propagation by considering a frame prediction mode (e.g., the prediction utilized by the LSF quantizer).

Figure 9:
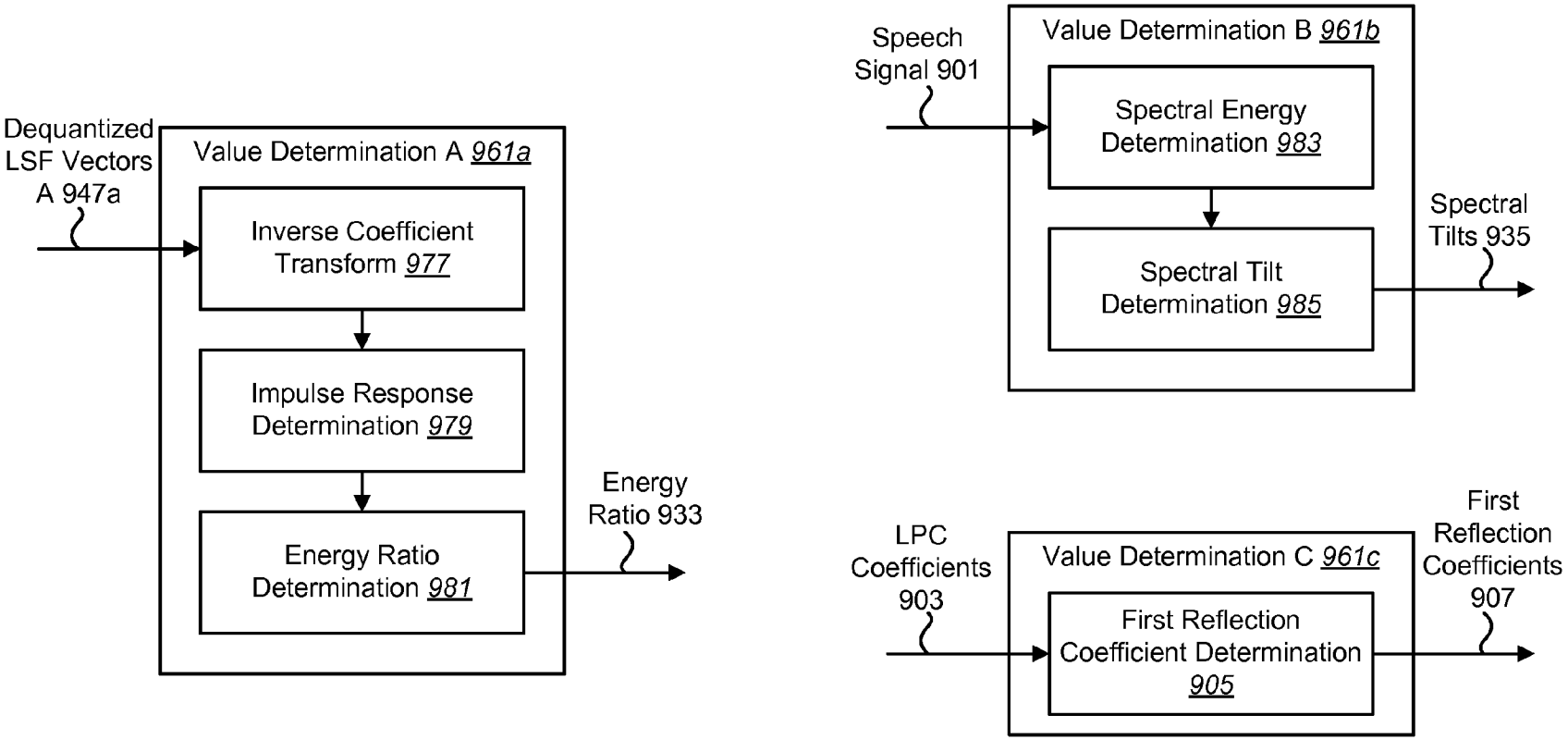
FIG. 9 is a block diagram illustrating examples of value determination modules.

FIG. 9 is a block diagram illustrating examples of value determination modules 961*a-c*. In particular, value determination module A 961*a*, value determination module B 961*b* and value determination module C 961*c* may be examples of the value determination module 761 described in connection with FIG. 7. Value determination module A 961*a*, value determination module B 961*b* and value determination module C 961*c* and/or one or more components thereof may be implemented in hardware (e.g., circuitry), software or a combination of both.

Value determination module A 961*a* determines an energy ratio 933 (e.g., R) based on a current frame property (e.g., a current frame synthesis filter impulse energy (e.g., $E_r$)) and a previous frame property (e.g., previous frame synthesis filter impulse response energy (e.g., $E_{n-1}$)). The energy ratio 933 may be one example of the value 763 described in connection with FIG. 7. Value determination module A 961*a* includes an inverse coefficient transform 977, an impulse response determination module 979 and an energy ratio determination module 981.

The inverse coefficient transform 977 obtains a current frame end LSF vector (e.g., $x_n^e$) and a previous frame end LSF vector (e.g., $x_{n-1}^e$) from dequantized LSF vectors A 947*a*. The inverse coefficient transform 977 transforms the current frame end LSF vector and the previous frame end LSF vector to obtain coefficients for a current frame end synthesis filter (e.g., $$\frac{1}{A_n^e(z)})$$

and a previous frame end synthesis filter (e.g., $$\frac{1}{A_{n-1}^e(z)}),$$

respectively. The coefficients for the current frame end synthesis filter and the previous frame end synthesis filter are provided to the impulse response determination module 979.

The impulse response determination module 979 determines the impulse responses of the current frame end synthesis filter and the previous frame end synthesis filter. For example, the impulse response determination module 979 excites the current frame end synthesis filter and the previous frame end synthesis filter with impulse signals, which yields truncated impulse responses (e.g., $h_{n-1}(i)$ and $h_n(i)$). The truncated impulse responses are provided to the energy ratio determination module 981.

The energy ratio determination module 981 determines a truncated current frame synthesis filter impulse energy (e.g., $E_n$) and a truncated previous frame synthesis filter impulse response energy (e.g., $E_{n-1}$) in accordance with Equation (3). The energy ratio determination module 981 then determines the energy ratio 933 between the current frame synthesis filter impulse energy (e.g., $E_n$) and the previous frame synthesis filter impulse response energy (e.g., $E_{n-1}$) in accordance with Equation (4).

Value determination module B 961*b* determines spectral tilts 935 based on a speech signal 901. Value determination module B 961*b* includes a spectral energy determination module 983 and a spectral tilt determination module 985. The spectral energy determination module 983 may obtain a speech signal 901. The spectral energy determination module 983 may transform a previous frame speech signal and a current frame speech signal into a previous frame frequency domain speech signal and a current frame frequency domain speech signal via a fast Fourier transform (FFT).

The spectral energy determination module 983 may determine previous frame low band spectral energy and previous frame high band spectral energy. For example, each of the previous frame frequency domain speech signal and the current frame frequency domain speech signal may be split into bands in order to compute energy per band. For instance, the spectral energy determination module 983 may sum the squares of each sample in the lower half of the previous frame frequency domain speech signal in order to obtain the previous frame low band spectral energy. Additionally, the spectral energy determination module 983 may sum the squares of each sample in the upper half of the previous frame frequency domain speech signal in order to obtain the previous frame upper band spectral energy.

The spectral energy determination module 983 may determine current frame low band spectral energy and current frame high band spectral energy. For example, the spectral energy determination module 983 may sum the squares of each sample in the lower half of the current frame frequency domain speech signal in order to obtain the current frame low band spectral energy. Additionally, the spectral energy determination module 983 may sum the squares of each sample in the upper half of the current frame frequency domain speech signal in order to obtain the current frame upper band spectral energy.

The previous frame low band spectral energy, the previous frame high band spectral energy, the current frame low band spectral energy and the current frame high band spectral energy may be provided to the spectral tilt determination module 985. The spectral tilt determination module 985 divides the previous frame high band spectral energy by the previous frame low band spectral energy to yield a previous frame spectral tilt. The spectral tilt determination module 985 divides the current frame high band spectral energy by the current frame low band spectral energy to yield a current frame spectral tilt. The previous frame spectral tilt 935 and the current frame spectral tilt 935 may be provided as the value 763.

Value determination module C 961*c* determines first reflection coefficients 907 (e.g., a previous frame first reflection coefficient and a current frame first reflection coefficient) based on LPC coefficients 903. For example, value determination module C 961*c* includes a first reflection coefficient determination module 905. In some configurations, the first reflection coefficient determination module 905 may determine the first reflection coefficients 907 based on the LPC coefficients 903 in accordance with Listing (3). In particular, Listing (3) illustrates one example of C code that may be utilized to convert LPC coefficients 903 into first reflection coefficients 907. Other known approaches to determining first reflection coefficients may be utilized. It should be noted that while a first reflection coefficient 907 may convey spectral tilt, it may not be numerically equal to the spectral tilt 935 (e.g., ratio of high band energy to low band energy) as determined by value determination module B 961b.

Listing (3)

```
* a2rc( )
*
* Convert from LPC to Reflection Coeff
*-----------------------------------------------------------------*/
void a2rc (
    float *a,          /* i : LPC coefficients              */
    float *refl,       /* o : Reflection coefficients       */
    short lpcorder     /* i : LPC order                     */
)
{
```

-continued

Listing (3)

```
    float f[M];
    short m, j, n;
    float km, denom, x;
    for (m = 0; m < lpcorder; m++)
    {
        f[m] = -a[m];
    }
    /* Initialization */
    for (m = lpcorder - 1; m >= 0; m--)
    {
        km = f [m];
        if (km <= -1.0 || km >= 1.0)
        {
            return;
        }
        refl[m] = -km;
        denom= 1.0f / (1.0f - km * km);
        for (j = 0; j < m / 2; j++)
        {
            n = m - 1 - j;
            x = denom * f[j] + km * denom * f[n];
            f[n] = denom * f[n] + km * denom * f[j];
            f[j] = x;
        }
        if (m & 1)
        {
            f[j] = denom * f[j] + km * denom * f[j];
        }
    }
    return;
}
```

Figure 10:
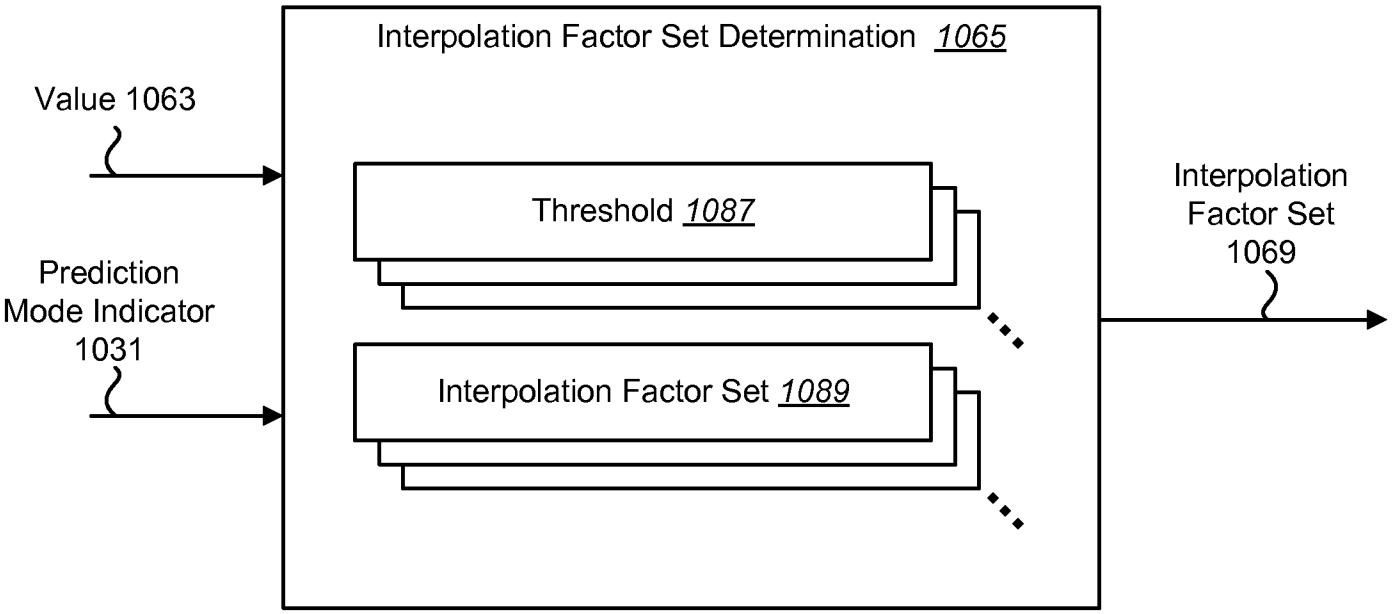
FIG. 10 is a block diagram illustrating one example of an interpolation factor set determination module.

FIG. 10 is a block diagram illustrating one example of an interpolation factor set determination module 1065. The interpolation factor set determination module 1065 may be implemented in hardware (e.g., circuitry), software or a combination of both. The interpolation factor set determination module 1065 includes thresholds 1087 and interpolation factor sets 1089. One or more of the thresholds 1087 specify a range as described above in connection with FIG. 7.

The interpolation factor set determination module 1065 obtains a value 1063 (e.g., an energy ratio 933, one or more spectral tilts 935 and/or one or more first reflection coefficients 907). The interpolation factor set determination module 1065 may determine whether the value 1063 is outside of the range and may determine an interpolation factor set 1069 based on the value 1063 and a prediction mode indicator 1031 if the value 1063 is outside of the range.

In one example as described in connection with Listing (1) and Listing (2) above, the value 1063 is an energy ratio R and the interpolation factor set determination module 1065 includes two thresholds, a first threshold TH1 and a second threshold TH2. Additionally, the interpolation factor set determination module 1065 includes five interpolation factor sets 1089, where Interpolation_factor_set_E is a default interpolation factor set. Furthermore, the prediction mode indicator 1031 may only indicate one of two prediction modes for the current frame in this example: predictive or non-predictive.

In this example, the range is specified by the second threshold TH2. If the energy ratio R is greater than or equal to the second threshold TH2, then the energy ratio R is within the range and the interpolation factor set determination module 1065 provides the default interpolation factor set (Interpolation_factor_set_E) as the interpolation factor set 1069. However, if the energy ratio R is less than the second threshold TH2, then the interpolation factor set determination module 1065 will determine one of the interpolation factor sets 1089 based on the energy ratio R and the prediction mode indicator 1031.

Specifically, if the energy ratio R is less than the first threshold TH1 and the prediction mode indicator 1031 indicates the non-predictive mode, then the interpolation factor set determination module 1065 provides Interpolation_factor_set_A as the interpolation factor set 1069. If the energy ratio R is less than the first threshold TH1 and the prediction mode indicator 1031 indicates the predictive mode, then the interpolation factor set determination module 1065 provides Interpolation_factor_set_B as the interpolation factor set 1069. If the energy ratio R is (greater than the first threshold TH1 and) less than the second threshold TH2 and the prediction mode indicator 1031 indicates the non-predictive mode, then the interpolation factor set determination module 1065 provides Interpolation_factor_set_C as the interpolation factor set 1069. If the energy ratio R is (greater than the first threshold TH1 and) less than the second threshold TH2 and the prediction mode indicator 1031 indicates the predictive mode, then the interpolation factor set determination module 1065 provides Interpolation_factor_set_D as the interpolation factor set 1069.

In another example, the value 1063 is a set of reflection coefficients, including a previous frame first reflection coefficient $R0_{n-1}$ and a current frame first reflection coefficient $R0_n$. Furthermore, the interpolation factor set determination module 1065 includes two thresholds, a first threshold TH1 and a second threshold TH2 (not to be confused with the thresholds TH1 and TH2 described in the foregoing example and Listing (2)). Additionally, the interpolation factor set determination module 1065 includes three interpolation factor sets 1089, where a third interpolation factor set is a default interpolation factor set. Furthermore, the prediction mode indicator 1031 may only indicate one of two prediction modes for the current frame in this example: predictive or non-predictive.

In this example, the range is a multidimensional range specified by the first threshold TH1 and the second threshold TH2. If the previous frame first reflection coefficient $R0_{n-1}$ is less than or equal to the first threshold TH1 and the current frame first reflection coefficient $R0_n$ is greater than or equal to the second threshold TH2, then the value 1063 is inside of the range and the interpolation factor set determination module 1065 provides the default interpolation factor set (Interpolation_factor_set_C) as the interpolation factor set 1069.

If the previous frame first reflection coefficient $R0_{n-1}$ is greater than the first threshold TH1 and the current frame first reflection coefficient $R0_n$ is less than the second threshold TH2, then the value 1063 is outside of the range. In this case, the interpolation factor set determination module 1065 provides a first interpolation factor set 1089 as the interpolation factor set 1069 if the prediction mode indicator 1031 indicates that the current frame prediction mode is non-predictive or a second interpolation factor set 1089 as the interpolation factor set 1069 if the prediction mode indicator 1031 indicates that the current frame prediction mode is predictive.

Figure 11:
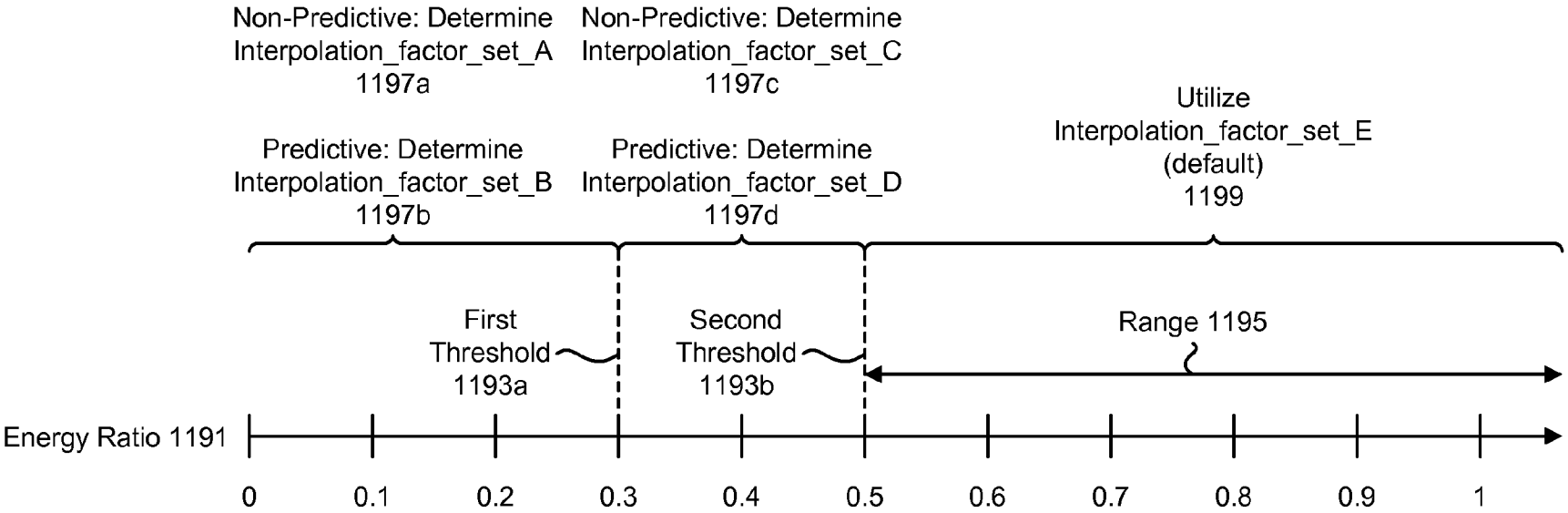
FIG. 11 is a diagram illustrating one example of determining an interpolation factor set.

FIG. 11 is a diagram illustrating one example of determining an interpolation factor set. In particular, FIG. 11 illustrates an example of determining an interpolation factor set based on an energy ratio 1191 and a prediction mode indicator in accordance with Listing (2). In this example, the first threshold 1193*a* (TH1) is 0.3 and the second threshold 1193*b* (TH2) is 0.5. As illustrated, the range 1195 is specified by the second threshold 1193*b* (e.g., the range 1195 is greater than or equal to the second threshold 1193*b*) and the first threshold 1193*a* is outside of the range 1195.

If the energy ratio 1191 is inside of the range 1195, the electronic device 737 may utilize Interpolation_factor_set_E 1199, which is a default interpolation factor set. If the energy ratio 1191 is less than the first threshold 1193*a* (outside of the range 1195) and the current frame prediction mode is non-predictive, the electronic device 737 may determine Interpolation_factor_set_A 1197*a*. If the energy ratio 1191 is less than the first threshold 1193*a* (outside of the range 1195) and the current frame prediction mode is predictive, the electronic device 737 may determine Interpolation_factor_set_B 1197*b*. If the energy ratio 1191 is greater than or equal to the first threshold 1193*a* and less than the second threshold 1193*b* (outside of the range 1195) and the current frame prediction mode is non-predictive, the electronic device 737 may determine Interpolation_factor_set_C 1197*c*. If the energy ratio 1191 is greater than or equal to the first threshold 1193*a* and less than the second threshold 1193*b* (outside of the range 1195) and the current frame prediction mode is predictive, the electronic device 737 may determine Interpolation_factor_set_D 1197*d*.

Figure 12:
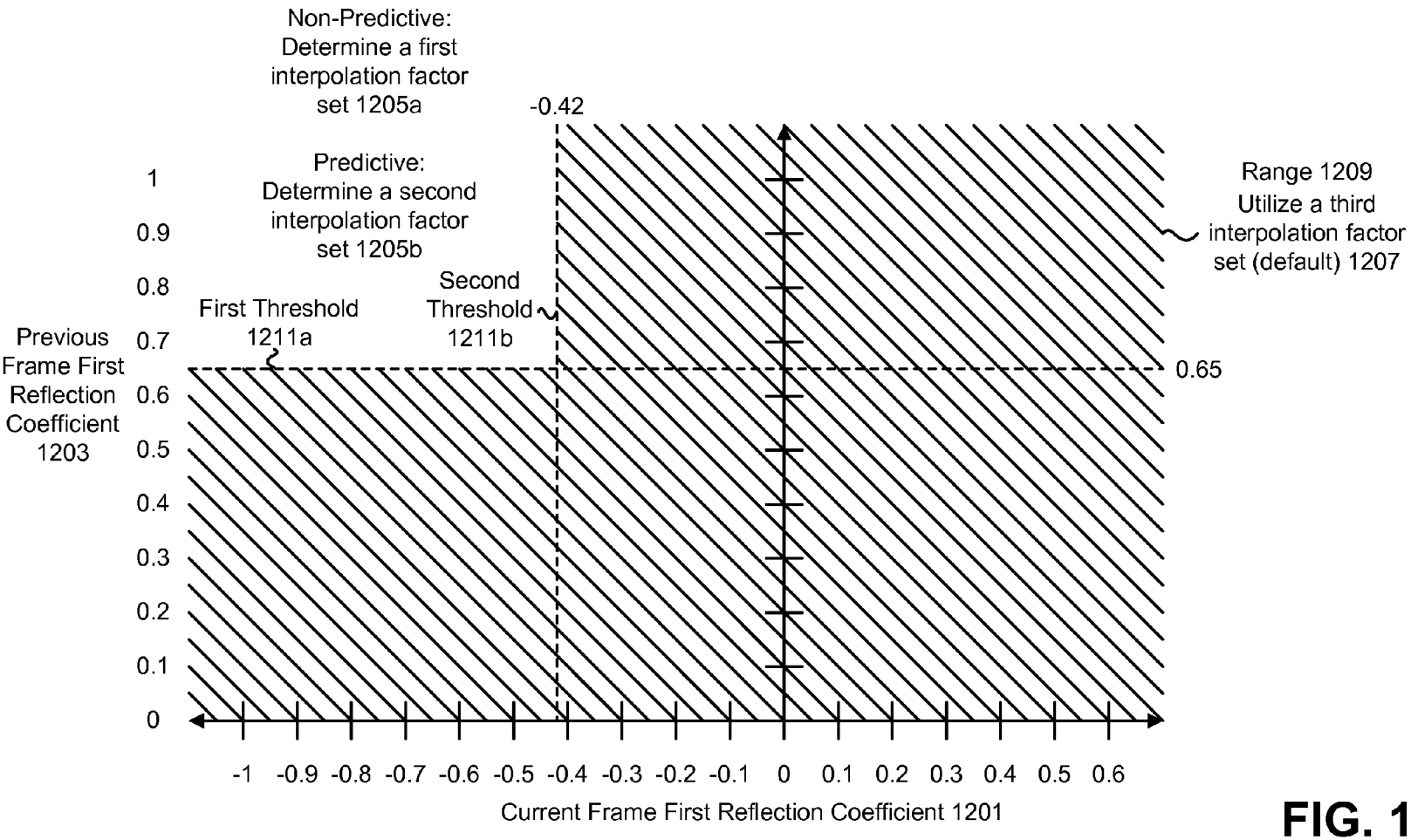
FIG. 12 is a diagram illustrating another example of determining an interpolation factor set.

FIG. 12 is a diagram illustrating another example of determining an interpolation factor set. In particular, FIG. 12 illustrates an example of determining an interpolation factor set based on a current frame first reflection coefficient 1201, a previous frame first reflection coefficient 1203 and a prediction mode indicator. In this example, a first threshold 1211*a* (TH1) is 0.65 and the second threshold 1211*b* (TH2) is −0.42. As illustrated, the range 1209 is a multidimensional range specified by the first threshold 1211*a* and the second threshold 1211*b* (e.g., the range 1209 is less than or equal to the first threshold 1211*a* for the previous frame first reflection coefficient dimension and greater than or equal to the second threshold 1211*b* for the current frame first reflection coefficient dimension).

If the value indicated by the previous frame first reflection coefficient 1203 and the current frame first reflection coefficient is inside of the range 1209, the electronic device 737 may utilize a third interpolation factor set 1207, which is a default interpolation factor set. If the previous frame first reflection coefficient 1203 is greater than the first threshold 1211*a* and the current frame first reflection coefficient 1201 is less than the second threshold 1211*b* (outside of the range 1209) and the current frame prediction mode is non-predictive, the electronic device 737 may determine a first interpolation factor set 1205*a*. If the previous frame first reflection coefficient 1203 is greater than the first threshold 1211*a* and the current frame first reflection coefficient 1201 is less than the second threshold 1211*b* (outside of the range 1209) and the current frame prediction mode is predictive, the electronic device 737 may determine a second interpolation factor set 1205*b*.

More specifically, the previous frame first reflection coefficient 1203 is checked to be >0.65. Unvoiced frames typically have a large positive first reflection coefficient. Additionally, the current frame first reflection coefficient 1201 is checked to be <−0.42. Voiced frames typically have a large negative first reflection coefficient. The electronic device 737 may utilize adaptive LSF interpolation under these conditions, where the previous frame first reflection coefficient 1203 indicates that the previous frame was an unvoiced frame and the current frame first reflection coefficient 1201 indicates that the current frame is a voiced frame.

In some configurations, additional or alternative thresholds may be used. For example, an electronic device may utilize adaptive LSF interpolation (e.g., determine other interpolation factor sets) in the opposite scenario where the previous frame was voiced and the current frame is unvoiced. For instance, if the previous frame first reflection coefficient is less than a third threshold (e.g., <−0.42, indicating a voiced frame) and the current frame first reflection coefficient is greater than a fourth threshold (e.g., >0.65, indicating an unvoiced frame), the electronic device 737 may determine a fourth interpolation factor set if the current frame prediction mode is non-predictive or may determine a fifth interpolation factor set if the current frame prediction mode is predictive.

Figure 13:
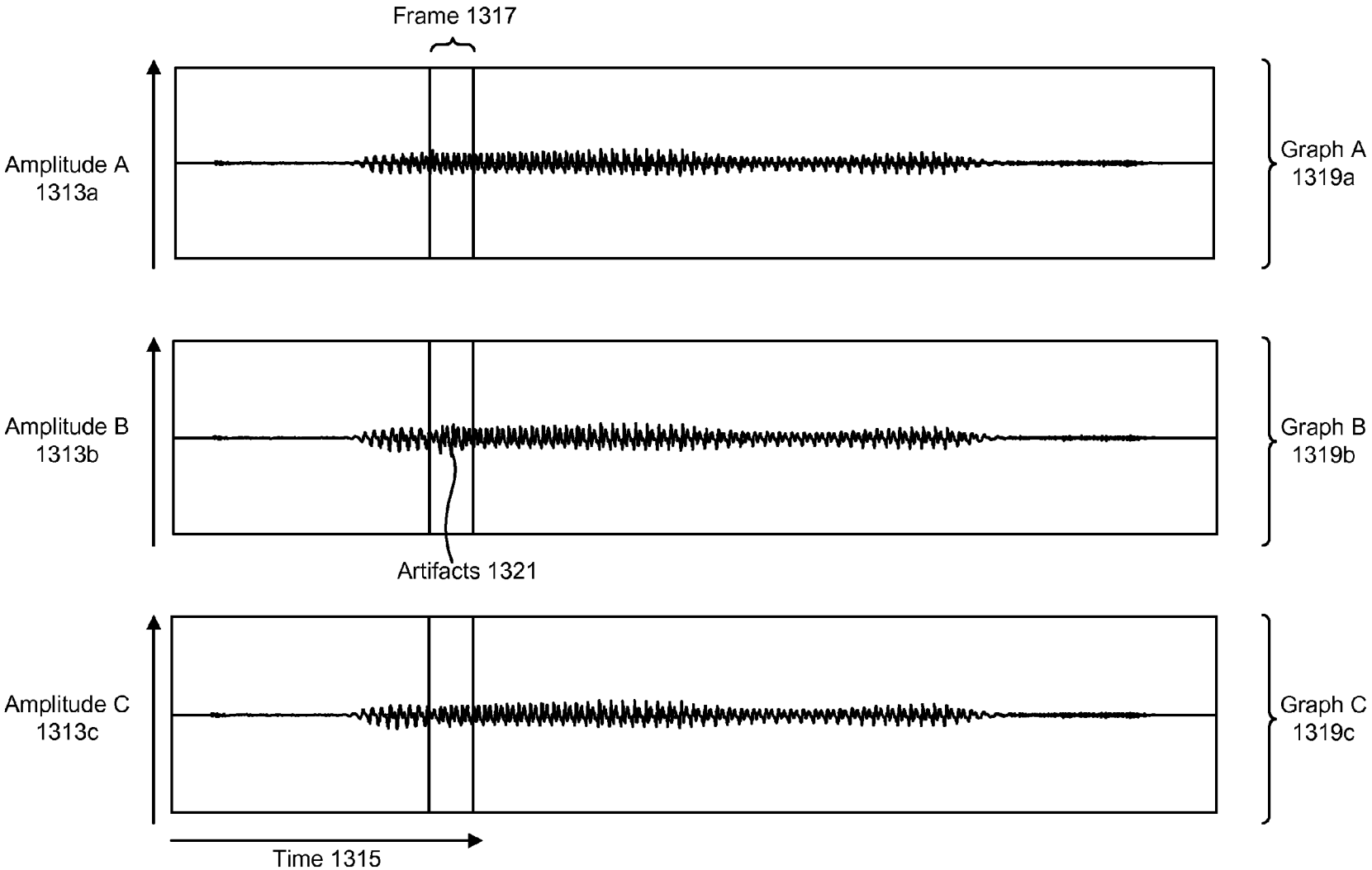
FIG. 13 includes graphs of examples of synthesized speech waveforms.

FIG. 13 includes graphs 1319*a-c* of examples of synthesized speech waveforms. The horizontal axes of the graphs 1319*a-c* are illustrated in time 1315 (e.g., minutes, seconds, milliseconds). The vertical axes of the graphs 1319*a-c* are illustrated in respective amplitudes 1313*a-c* (e.g., sample amplitudes of voltage or current). FIG. 13 indicates one 20 ms frame 1317 of the synthesized speech waveforms.

Graph A 1319*a* illustrates one example of a synthesized speech waveform, where no frame erasure has occurred (e.g., in a clean channel case). Accordingly, the frame 1317 for graph A 1319*a* may be observed as a reference for comparison.

Graph B 1319*b* illustrates another example of a synthesized speech waveform. The frame 1317 in graph B 1319*b* is a first correctly received frame following an erased frame. In graph B 1319*b*, the systems and methods disclosed herein are not applied to the frame 1317. As can be observed, the frame 1317 in graph B 1319*b* exhibits artifacts 1321 that do not occur in the case described in connection with graph A 1319*a*.

Graph C 1319*c* illustrates another example of a synthesized speech waveform. The frame 1317 in graph C 1319*c* is the first correctly received frame following an erased frame. In graph C 1319*c*, the systems and methods disclosed herein are applied to the frame 1317. For example, the electronic device 737 may determine an interpolation factor set based on the value 763 and the prediction mode indicator 731 for the frame 1317 (e.g., frame n in Equation (2)). As can be observed, the frame 1317 in graph C 1319*c* does not exhibit the speech artifacts 1321 of the frame 1317 in graph B 1319*b*. For instance, the adaptive LSF interpolation scheme described herein may avoid or reduce speech artifacts in synthesized speech after an erased frame.

Figure 14:
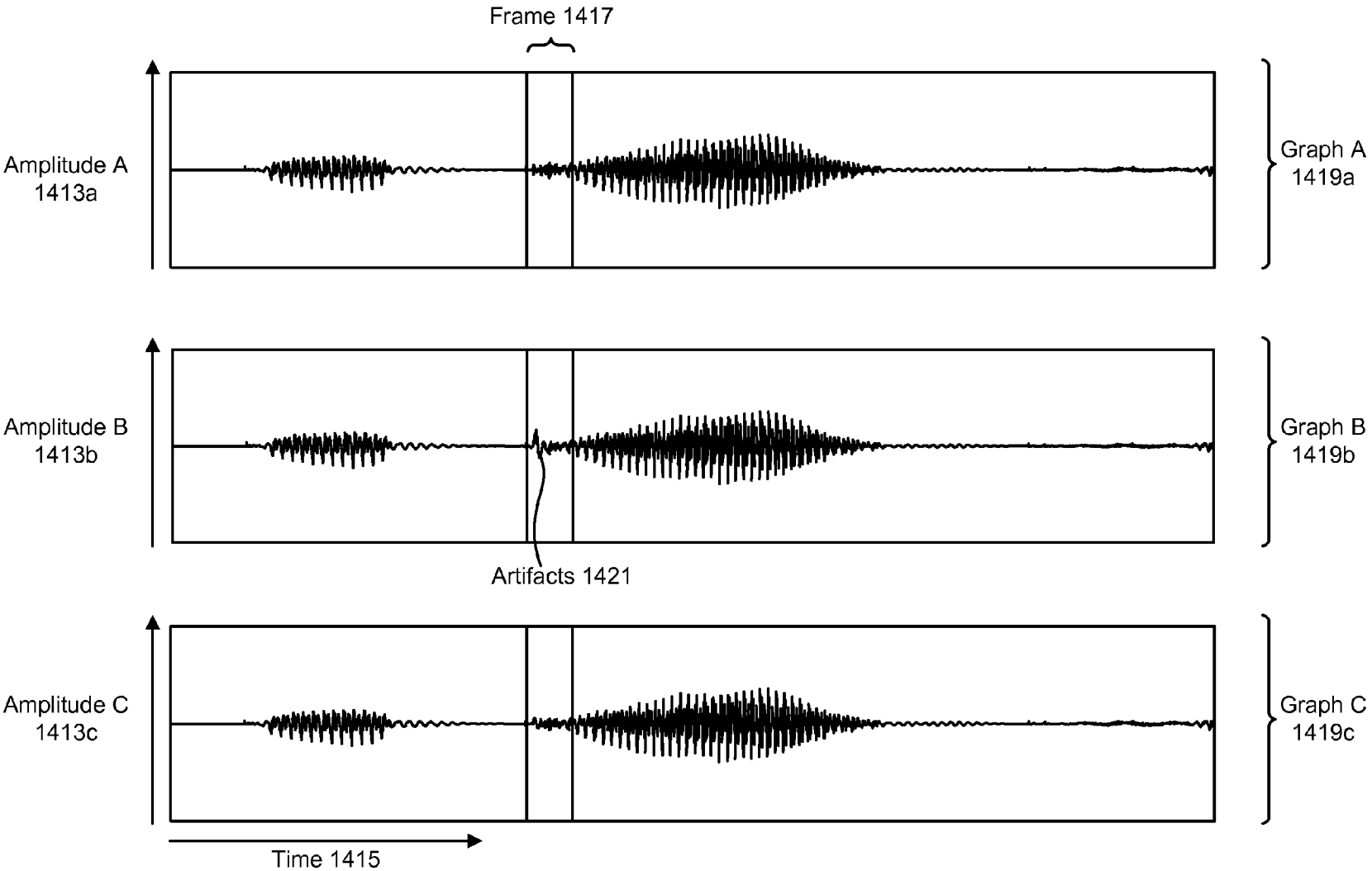
FIG. 14 includes graphs of additional examples of synthesized speech waveforms.

FIG. 14 includes graphs 1419*a-c* of additional examples of synthesized speech waveforms. The horizontal axes of the graphs 1419*a-c* are illustrated in time 1415 (e.g., minutes, seconds, milliseconds). The vertical axes of the graphs 1419*a-c* are illustrated in respective amplitudes 1413*a-c* (e.g., sample amplitudes of voltage or current). FIG. 14 indicates one 20 ms frame 1417 of the synthesized speech waveforms.

Graph A 1419*a* illustrates one example of a synthesized speech waveform, where no frame erasure has occurred (e.g., in a clean channel case). Accordingly, the frame 1417 for graph A 1419*a* may be observed as a reference for comparison.

Graph B 1419*b* illustrates another example of a synthesized speech waveform. The frame 1417 in graph B 1419*b* is a first correctly received frame following an erased frame. In graph B 1419*b*, the systems and methods disclosed herein are not applied to the frame 1417. As can be observed, the frame 1417 in graph B 1419*b* exhibits artifacts 1421 that do not occur in the case described in connection with graph A 1419*a*.

Graph C 1419*c* illustrates another example of a synthesized speech waveform. The frame 1417 in graph C 1419*c* is the first correctly received frame following an erased frame. In graph C 1419*c*, the systems and methods disclosed herein are applied to the frame 1417. For example, the electronic device 737 may determine an interpolation factor set based on the value 763 and the prediction mode indicator 731 for the frame 1417 (e.g., frame n in Equation (2)). As can be observed, the frame 1417 in graph C 1419*c* does not exhibit the speech artifacts 1421 of the frame 1417 in graph B 1419*b*.

For instance, the adaptive LSF interpolation scheme described herein may avoid or reduce speech artifacts in synthesized speech after an erased frame.

Figure 15:
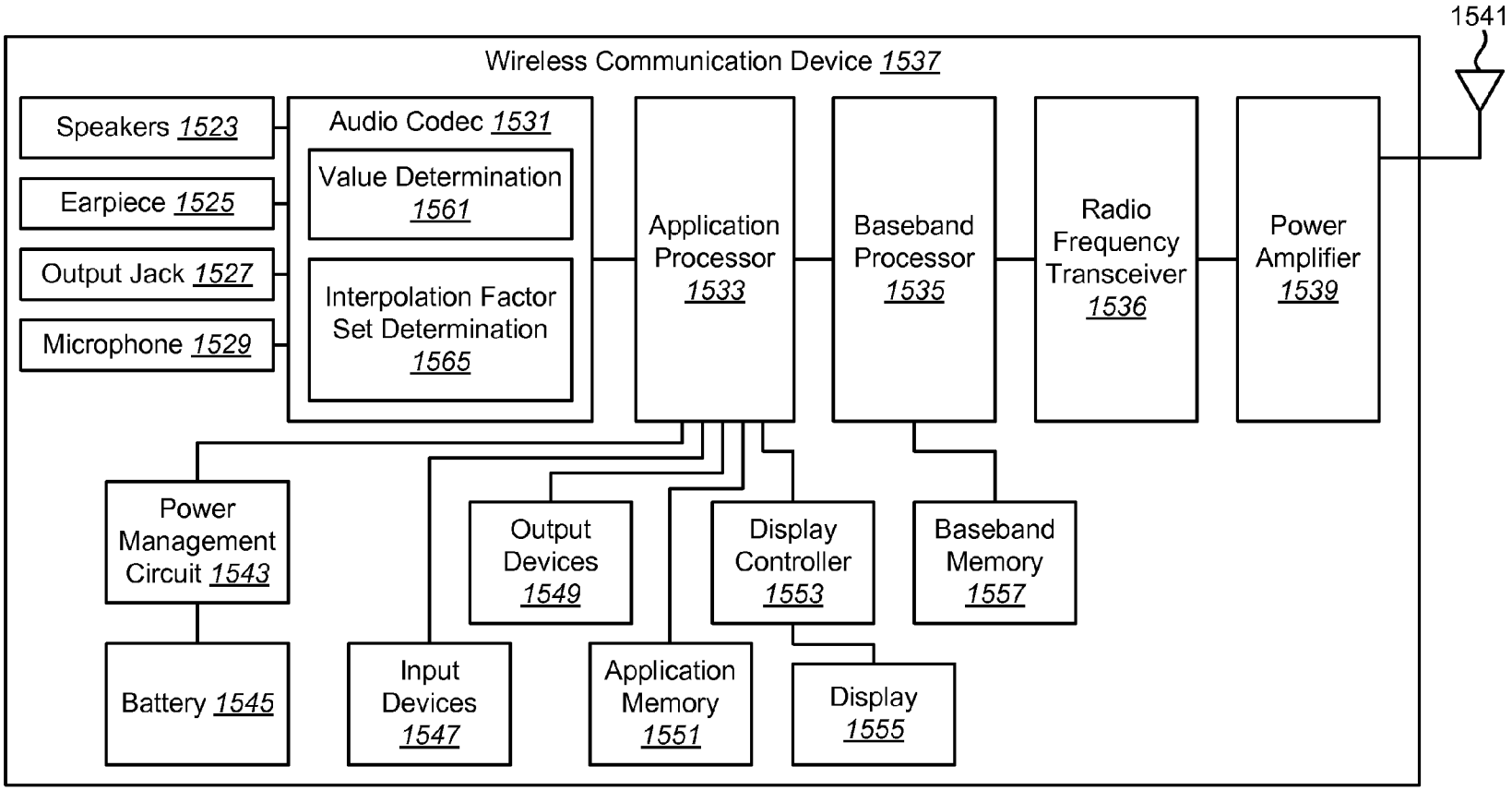
FIG. 15 is a block diagram illustrating one configuration of a wireless communication device in which systems and methods for determining an interpolation factor set may be implemented.

FIG. 15 is a block diagram illustrating one configuration of a wireless communication device 1537 in which systems and methods for determining an interpolation factor set may be implemented. The wireless communication device 1537 illustrated in FIG. 15 may be an example of at least one of the electronic devices described herein. The wireless communication device 1537 may include an application processor 1533. The application processor 1533 generally processes instructions (e.g., runs programs) to perform functions on the wireless communication device 1537. The application processor 1533 may be coupled to an audio coder/decoder (codec) 1531.

The audio codec 1531 may be used for coding and/or decoding audio signals. The audio codec 1531 may be coupled to at least one speaker 1523, an earpiece 1525, an output jack 1527 and/or at least one microphone 1529. The speakers 1523 may include one or more electro-acoustic transducers that convert electrical or electronic signals into acoustic signals. For example, the speakers 1523 may be used to play music or output a speakerphone conversation, etc. The earpiece 1525 may be another speaker or electro-acoustic transducer that can be used to output acoustic signals (e.g., speech signals) to a user. For example, the earpiece 1525 may be used such that only a user may reliably hear the acoustic signal. The output jack 1527 may be used for coupling other devices to the wireless communication device 1537 for outputting audio, such as headphones. The speakers 1523, earpiece 1525 and/or output jack 1527 may generally be used for outputting an audio signal from the audio codec 1531. The at least one microphone 1529 may be an acousto-electric transducer that converts an acoustic signal (such as a user's voice) into electrical or electronic signals that are provided to the audio codec 1531.

The audio codec 1531 (e.g., a decoder) may include a value determination module 1561 and/or an interpolation factor set determination module 1565. The value determination module 1561 may determine a value as described above. The interpolation factor set determination module 1565 may determine an interpolation factor set as described above.

The application processor 1533 may also be coupled to a power management circuit 1543. One example of a power management circuit 1543 is a power management integrated circuit (PMIC), which may be used to manage the electrical power consumption of the wireless communication device 1537. The power management circuit 1543 may be coupled to a battery 1545. The battery 1545 may generally provide electrical power to the wireless communication device 1537. For example, the battery 1545 and/or the power management circuit 1543 may be coupled to at least one of the elements included in the wireless communication device 1537.

The application processor 1533 may be coupled to at least one input device 1547 for receiving input. Examples of input devices 1547 include infrared sensors, image sensors, accelerometers, touch sensors, keypads, etc. The input devices 1547 may allow user interaction with the wireless communication device 1537. The application processor 1533 may also be coupled to one or more output devices 1549. Examples of output devices 1549 include printers, projectors, screens, haptic devices, etc. The output devices 1549 may allow the wireless communication device 1537 to produce output that may be experienced by a user.

The application processor 1533 may be coupled to application memory 1551. The application memory 1551 may be any electronic device that is capable of storing electronic information. Examples of application memory 1551 include double data rate synchronous dynamic random access memory (DDRAM), synchronous dynamic random access memory (SDRAM), flash memory, etc. The application memory 1551 may provide storage for the application processor 1533. For instance, the application memory 1551 may store data and/or instructions for the functioning of programs that are run on the application processor 1533.

The application processor 1533 may be coupled to a display controller 1553, which in turn may be coupled to a display 1555. The display controller 1553 may be a hardware block that is used to generate images on the display 1555. For example, the display controller 1553 may translate instructions and/or data from the application processor 1533 into images that can be presented on the display 1555. Examples of the display 1555 include liquid crystal display (LCD) panels, light emitting diode (LED) panels, cathode ray tube (CRT) displays, plasma displays, etc.

The application processor 1533 may be coupled to a baseband processor 1535. The baseband processor 1535 generally processes communication signals. For example, the baseband processor 1535 may demodulate and/or decode received signals. Additionally or alternatively, the baseband processor 1535 may encode and/or modulate signals in preparation for transmission.

The baseband processor 1535 may be coupled to baseband memory 1557. The baseband memory 1557 may be any electronic device capable of storing electronic information, such as SDRAM, DDRAM, flash memory, etc. The baseband processor 1535 may read information (e.g., instructions and/or data) from and/or write information to the baseband memory 1557. Additionally or alternatively, the baseband processor 1535 may use instructions and/or data stored in the baseband memory 1557 to perform communication operations.

The baseband processor 1535 may be coupled to a radio frequency (RF) transceiver 1536. The RF transceiver 1536 may be coupled to a power amplifier 1539 and one or more antennas 1541. The RF transceiver 1536 may transmit and/or receive radio frequency signals. For example, the RF transceiver 1536 may transmit an RF signal using a power amplifier 1539 and at least one antenna 1541. The RF transceiver 1536 may also receive RF signals using the one or more antennas 1541. It should be noted that one or more of the elements included in the wireless communication device 1537 may be coupled to a general bus that may enable communication between the elements.

Figure 16:
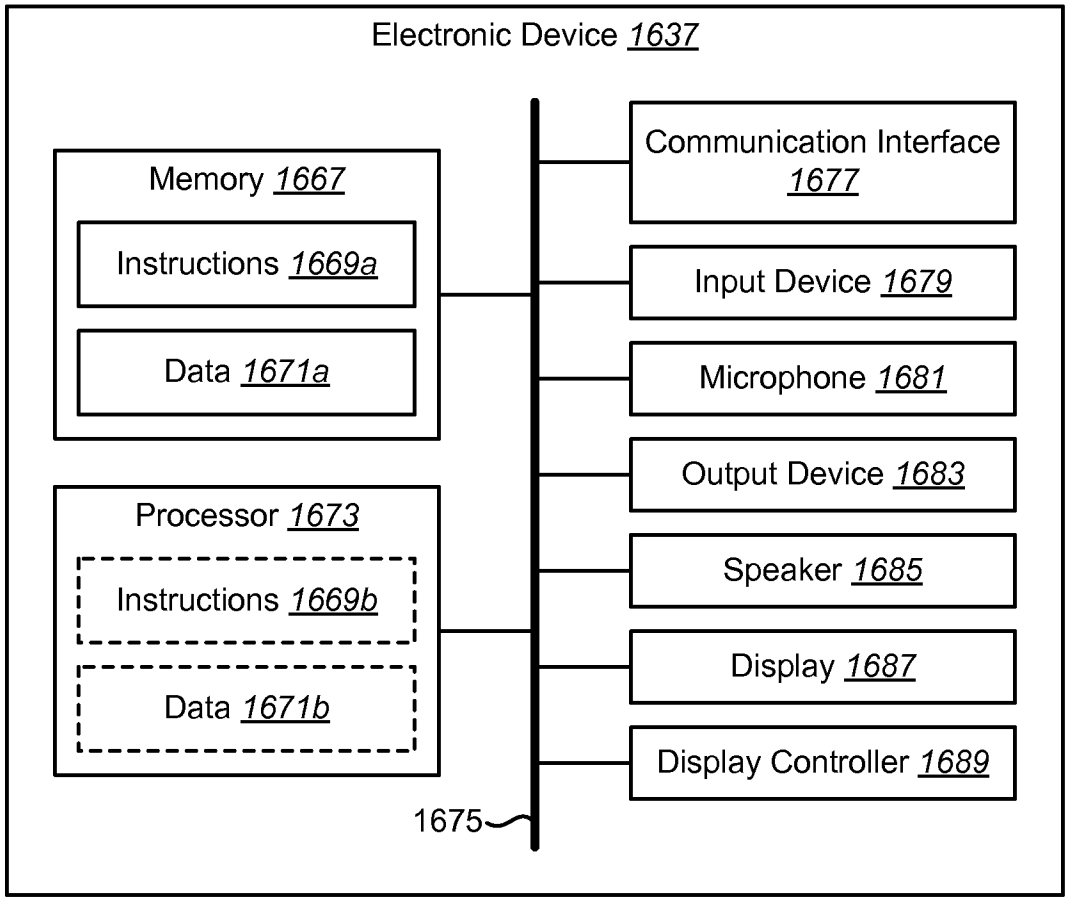
FIG. 16 illustrates various components that may be utilized in an electronic device.

FIG. 16 illustrates various components that may be utilized in an electronic device 1637. The illustrated components may be located within the same physical structure or in separate housings or structures. The electronic device 1637 described in connection with FIG. 16 may be implemented in accordance with one or more of the electronic devices described herein. The electronic device 1637 includes a processor 1673. The processor 1673 may be a general purpose single- or multi-chip microprocessor (e.g., an ARM), a special purpose microprocessor (e.g., a digital signal processor (DSP)), a microcontroller, a programmable gate array, etc. The processor 1673 may be referred to as a central processing unit (CPU). Although just a single processor 1673 is shown in the electronic device 1637 of FIG. 16, in an alternative configuration, a combination of processors (e.g., an ARM and DSP) could be used.

The electronic device 1637 also includes memory 1667 in electronic communication with the processor 1673. That is, the processor 1673 can read information from and/or write information to the memory 1667. The memory 1667 may be any electronic component capable of storing electronic information. The memory 1667 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1671*a* and instructions 1669*a* may be stored in the memory 1667. The instructions 1669*a* may include one or more programs, routines, sub-routines, functions, procedures, etc. The instructions 1669*a* may include a single computer-readable statement or many computer-readable statements. The instructions 1669*a* may be executable by the processor 1673 to implement one or more of the methods, functions and procedures described above. Executing the instructions 1669*a* may involve the use of the data 1671*a* that is stored in the memory 1667. FIG. 16 shows some instructions 1669*b* and data 1671*b* being loaded into the processor 1673 (which may come from instructions 1669*a* and data 1671*a*).

The electronic device 1637 may also include one or more communication interfaces 1677 for communicating with other electronic devices. The communication interfaces 1677 may be based on wired communication technology, wireless communication technology, or both. Examples of different types of communication interfaces 1677 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1637 may also include one or more input devices 1679 and one or more output devices 1683. Examples of different kinds of input devices 1679 include a keyboard, mouse, microphone, remote control device, button, joystick, trackball, touchpad, lightpen, etc. For instance, the electronic device 1637 may include one or more microphones 1681 for capturing acoustic signals. In one configuration, a microphone 1681 may be a transducer that converts acoustic signals (e.g., voice, speech) into electrical or electronic signals. Examples of different kinds of output devices 1683 include a speaker, printer, etc. For instance, the electronic device 1637 may include one or more speakers 1685. In one configuration, a speaker 1685 may be a transducer that converts electrical or electronic signals into acoustic signals. One specific type of output device which may be typically included in an electronic device 1637 is a display device 1687. Display devices 1687 used with configurations disclosed herein may utilize any suitable image projection technology, such as a cathode ray tube (CRT), liquid crystal display (LCD), light-emitting diode (LED), gas plasma, electroluminescence, or the like. A display controller 1689 may also be provided, for converting data stored in the memory 1667 into text, graphics, and/or moving images (as appropriate) shown on the display device 1687.

The various components of the electronic device 1637 may be coupled together by one or more buses, which may include a power bus, a control signal bus, a status signal bus, a data bus, etc. For simplicity, the various buses are illustrated in FIG. 16 as a bus system 1675. It should be noted that FIG. 16 illustrates only one possible configuration of an electronic device 1637. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, etc., described in connection with any one of the configurations described herein may be combined with one or more of the functions, procedures, components, elements, structures, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-Ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for determining an interpolation factor set by an electronic device, comprising:

determining a value based on a current frame property and a previous frame property;

determining whether the value is outside of a range;

determining an interpolation factor set based on a determination that the value is outside of the range and a prediction mode indicator;

interpolating subframe line spectral frequency (LSF) vectors based on the interpolation factor set to produce interpolated LSF vectors; and synthesizing a speech signal based on the interpolated LSF vectors.

2. The method of claim 1, wherein the prediction mode indicator indicates one of three or more prediction modes.

3. The method of claim 1, wherein the value is an energy ratio based on a current frame synthesis filter impulse response energy and a previous frame synthesis filter impulse response energy.

4. The method of claim 3, wherein determining whether the value is outside of the range comprises determining whether the energy ratio is less than a threshold.

5. The method of claim 1, wherein the interpolation factor set includes two or more interpolation factors.

6. The method of claim 1, further comprising transforming the interpolated LSF vectors into coefficients.

7. The method of claim 1, wherein interpolating subframe LSF vectors based on the interpolation factor set comprises multiplying a current frame end LSF vector by a first interpolation factor, multiplying a previous frame end LSF vector by a second interpolation factor, and multiplying a current frame mid LSF vector by a difference factor.

8. The method of claim 1, further comprising utilizing a default interpolation factor set in response to a determination that the value is not outside of the range.

9. The method of claim 1, wherein the prediction mode indicator indicates a prediction mode of a current frame.

10. An electronic device for determining an interpolation factor set, comprising:

a processor configured to:

determine a value based on a current frame property and a previous frame property;

determine whether the value is outside of a range;

determine an interpolation factor set based on a determination that the value is outside of the range and a prediction mode indicator;

interpolate subframe line spectral frequency (LSF) vectors based on the interpolation factor set to produce interpolated LSF vectors; and synthesize a speech signal based on the interpolated LSF vectors.

11. The electronic device of claim 10, wherein the prediction mode indicator indicates one of three or more prediction modes.

12. The electronic device of claim 10, wherein the value is an energy ratio based on a current frame synthesis filter impulse response energy and a previous frame synthesis filter impulse response energy.

13. The electronic device of claim 12, wherein the processor is configured to determine whether the energy ratio is less than a threshold.

14. The electronic device of claim 10, wherein the interpolation factor set includes two or more interpolation factors.

15. The electronic device of claim 10, wherein the processor is configured to transform the interpolated LSF vectors into coefficients.

16. The electronic device of claim 10, wherein the processor is configured to multiply a current frame end LSF vector by a first interpolation factor, to multiply a previous frame end LSF vector by a second interpolation factor, and to multiply a current frame mid LSF vector by a difference factor.

17. The electronic device of claim 10, wherein the processor is configured to utilize a default interpolation factor set in response to a determination that the value is not outside of the range.

18. The electronic device of claim 10, wherein the prediction mode indicator indicates a prediction mode of a current frame.

19. A computer-program product for determining an interpolation factor set, comprising a non-transitory tangible computer-readable medium having instructions thereon, the instructions comprising:

code for causing an electronic device to determine a value based on a current frame property and a previous frame property;

code for causing the electronic device to determine whether the value is outside of a range;

code for causing the electronic device to determine an interpolation factor set based on a determination that the value is outside of the range and a prediction mode indicator;

code for causing the electronic device to interpolate subframe line spectral frequency (LSF) vectors based on the interpolation factor set to produce interpolated LSF vectors; and code for causing the electronic device to synthesize a speech signal based on the interpolated LSF vectors.

20. The computer-program product of claim 19, wherein the prediction mode indicator indicates one of three or more prediction modes.

21. The computer-program product of claim 19, wherein the value is an energy ratio based on a current frame synthesis filter impulse response energy and a previous frame synthesis filter impulse response energy.

22. The computer-program product of claim 19, wherein the interpolation factor set includes two or more interpolation factors.

23. The computer-program product of claim 19, further comprising code for causing the electronic device to transform the interpolated LSF vectors into coefficients.

24. The computer-program product of claim 19, further comprising code for causing the electronic device to utilize a default interpolation factor set in response to a determination that the value is not outside of the range.

25. The computer-program product of claim 19, wherein the prediction mode indicator indicates a prediction mode of a current frame.

26. An apparatus for determining an interpolation factor set, comprising:

means for determining a value based on a current frame property and a previous frame property;

means for determining whether the value is outside of a range;

means for determining an interpolation factor set based on a determination that the value is outside of the range and a prediction mode indicator;

means for interpolating subframe line spectral frequency (LSF) vectors based on the interpolation factor set to produce interpolated LSF vectors; and means for synthesizing a speech signal based on the interpolated LSF vectors.

27. The apparatus of claim 26, wherein the prediction mode indicator indicates one of three or more prediction modes.

28. The apparatus of claim 26, wherein the value is an energy ratio based on a current frame synthesis filter impulse response energy and a previous frame synthesis filter impulse response energy.

29. The apparatus of claim 26, wherein the interpolation factor set includes two or more interpolation factors.

30. The apparatus of claim 26, further comprising means for transforming the interpolated LSF vectors into coefficients.

31. The apparatus of claim 26, further comprising means for utilizing a default interpolation factor set in response to a determination that the value is not outside of the range.

32. The apparatus of claim 26, wherein the prediction mode indicator indicates a prediction mode of a current frame.

* * * * *